US008456368B2

(12) United States Patent
Murata et al.

(10) Patent No.: US 8,456,368 B2
(45) Date of Patent: Jun. 4, 2013

(54) ANTENNA DEVICE AND RADIO-WAVE RECEIVER WITH SUCH ANTENNA DEVICE

(75) Inventors: Yoshiyuki Murata, Chichibu-gun (JP); Hideo Tasaka, Ome (JP); Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 681 days.

(21) Appl. No.: 12/691,095

(22) Filed: Jan. 21, 2010

(65) Prior Publication Data

US 2010/0188307 A1 Jul. 29, 2010

(30) Foreign Application Priority Data

Jan. 27, 2009 (JP) ..... 2009-015211
May 25, 2009 (JP) ..... 2009-124889

(51) Int. Cl.
*H01Q 1/24* (2006.01)
*H01Q 7/08* (2006.01)

(52) U.S. Cl.
USPC ..... 343/702; 343/718; 343/788

(58) Field of Classification Search
USPC ..... 343/702, 718, 720, 788; 368/10, 368/47
See application file for complete search history.

(56) References Cited

U.S. PATENT DOCUMENTS 6,134,188 A 10/2000 Ganter et al.
7,061,439 B1 6/2006 Minami et al.
7,280,438 B2 * 10/2007 Fujisawa ..... 368/47
7,307,594 B2 12/2007 Noguchi
7,345,957 B2 3/2008 Nirasawa
7,355,556 B2 * 4/2008 Abe et al. ..... 343/788
7,515,112 B2 4/2009 Someya et al.
7,724,199 B2 5/2010 Someya et al.
7,777,680 B2 * 8/2010 Abe et al. ..... 343/718
2007/0132648 A1 6/2007 Abe
2009/0201769 A1 8/2009 Miyahara

FOREIGN PATENT DOCUMENTS

CN 1780052 A 5/2006
DE 4407116 A1 9/1995
EP 2088484 A2 8/2009

(Continued)

OTHER PUBLICATIONS

Extended European Search Report dated Jul. 1, 2010 (in English) issued in counterpart European Application No. 10151495.8.

(Continued)

*Primary Examiner* — Michael C Wimer
(74) *Attorney, Agent, or Firm* — Holtz, Holtz, Goodman & Chick, P.C.

(57) ABSTRACT

A radio-wave receiver is provided with a hollow-cylindrical case, a plate-like module member accommodated within the cylindrical case, a transparent member closing one opening end of the cylindrical case, a cover closing the other opening end of the cylindrical case, and an antenna structure disposed on the side position of the plate-like module member. The antenna structure is provided with a core including a plurality of plate-like magnetic members layered on each other in a direction perpendicular to the thickness direction of the plate-like module member, a coil wound around a central straight part of the core, and bent end portions extending from both ends of the core and bent to conform to the inner periphery of the cylindrical case.

13 Claims, 21 Drawing Sheets

FOREIGN PATENT DOCUMENTS

| | | | |
|---|---|---|---|
| FR | 2878653 | A1 | 6/2006 |
| JP | 2004-264288 | A | 9/2004 |
| JP | 2006-140659 | A | 6/2006 |
| JP | 2006-242940 | A | 9/2006 |
| JP | 2007-240401 | A | 9/2007 |
| JP | 2008-141387 | A | 6/2008 |
| JP | 2008-141389 | A | 6/2008 |
| JP | 2008-177820 | A | 7/2008 |

OTHER PUBLICATIONS

Chinese Office Action dated Apr. 26, 2012 (and English translation thereof) in counterpart Chinese Application No. 201010103984.8.
Japanese Office Action dated Feb. 15, 2011 (and English translation thereof) in counterpart Japanese Application No. 2009-015211.
Japanese Office Action dated Apr. 12, 2011 (and English translation thereof) in counterpart Japanese Application No. 2009-124889.

* cited by examiner

ANTENNA DEVICE AND RADIO-WAVE RECEIVER WITH SUCH ANTENNA DEVICE

CROSS-REFERENCE TO RELATED APPLICATIONS

This application is based upon and claims the benefit of priority from prior Japanese Patent Applications No. 2009-015211, filed Jan. 27, 2009; and No. 2009-124889, filed May 25, 2009, the entire contents of both of which are incorporated herein by reference.

BACKGROUND OF THE INVENTION

1. Field of the Invention

The present invention relates to antenna devices and radio-wave receivers with such antenna devices.

2. Description of the Related Art

In the past, radio-wave receivers such as radio-wave controlled wristwatches are known which include an antenna device which receives standard radio waves including time information to set a current time automatically. Many radio-wave controlled timepieces include an antenna structure which comprises a core of a magnetic material such as amorphous metal or ferrite of high reception sensitivity around which core a coil is wound to receive standard radio waves.

As the core of the antenna structure is longer and its radio wave reception area is larger, the reception sensitivity of the antenna structure improves. If the antenna structure is provided within a small radio-wave receiver such as a wristwatch type radio-wave controlled timepiece, it must be small because a space within the timepiece.

Radio-wave receivers are known which use a small antenna structure which includes a core of layered strip-like amorphous layers, as disclosed in Japanese patent application KOKAI publications No. 2008-141387 and No. 2008-141389.

In these radio-wave receivers, the strip-like layers of the core are layered in the thickness direction of a circuit board or a module member of the radio-wave receiver layered on the circuit board within the receiver. Thus, when the antenna structure is disposed at a straight edge of the circuit board, extra space is needed, which corresponds to the width of the core. Thus, the antenna structure cannot be disposed efficiently within a limited inner space of the receiver. In order to ensure a space for accommodating the antenna structure, the case must be enlarged.

BRIEF SUMMARY OF THE INVENTION

It is therefore an object of the present invention to provide a miniaturized light antenna structure and radio-wave receiver with high reception sensitivity.

In order to achieve the above object, one aspect of the present invention is to provide an antenna device comprising: a plate-like module member to be accommodated within a hollow-cylindrical case; and an antenna structure disposed on a side position of the plate-like module member. The antenna structure comprises a core including a plurality of plate-like magnetic members layered on each other in a direction perpendicular to the thickness direction of the plate-like module member, a coil wound around a central straight part of the core, and bent end portions extending from both ends of the core and bent to conform to the inner periphery of the cylindrical case.

Another aspect of the present invention is to it provide a radio-wave receiver comprising: a hollow-cylindrical case; a plate-like module member accommodated within the case; a transparent member closing one opening end of the cylindrical case; a cover closing the other opening end of the cylindrical case; and an antenna structure disposed on a side position of the plate-like module member. The antenna structure comprises a core including a plurality of plate-like magnetic members layered on each other in a direction perpendicular to the thickness direction of the plate-like module member, a coil wound around a central straight part of the core, and bent end portions extending from both ends of the core and bent to conform to the inner periphery of the cylindrical case.

According to this invention, the core of the antenna structure includes a plurality of plate-like magnetic members layered on each other in a direction perpendicular to the thickness direction of the module member, the antenna structure structured as disclosed above is disposed on the side position of the plate-like module member, and further a pair of bent end portions extending from the both ends of the core are bent to conform to the inner periphery of the cylindrical case. Thus, the antenna structure is disposed within a limited inner space of the cylindrical case in a compact manner. Therefore, even if the core itself is not large, the antenna structure can collect external magnetic flux efficiently. So that the antenna device or radio-wave controlled wristwatch which has a high reception sensitivity is provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, together with the general description given above and the detailed description of the embodiments given below, serve to explain the principles of the invention.

DETAILED DESCRIPTION OF THE INVENTION

Referring to the accompanying drawings, several preferred embodiments of an antenna device and radio-wave receiver with the antenna device according to the present invention will be described specifically.

(First Embodiment)

First, referring to FIGS. 1-5, the first embodiment of an antenna device and radio-wave receiver of the present invention will be described. In this embodiment, a radio-wave controlled wristwatch with the antenna device as a radio-wave receiver will be described as an example.

Figure 1:
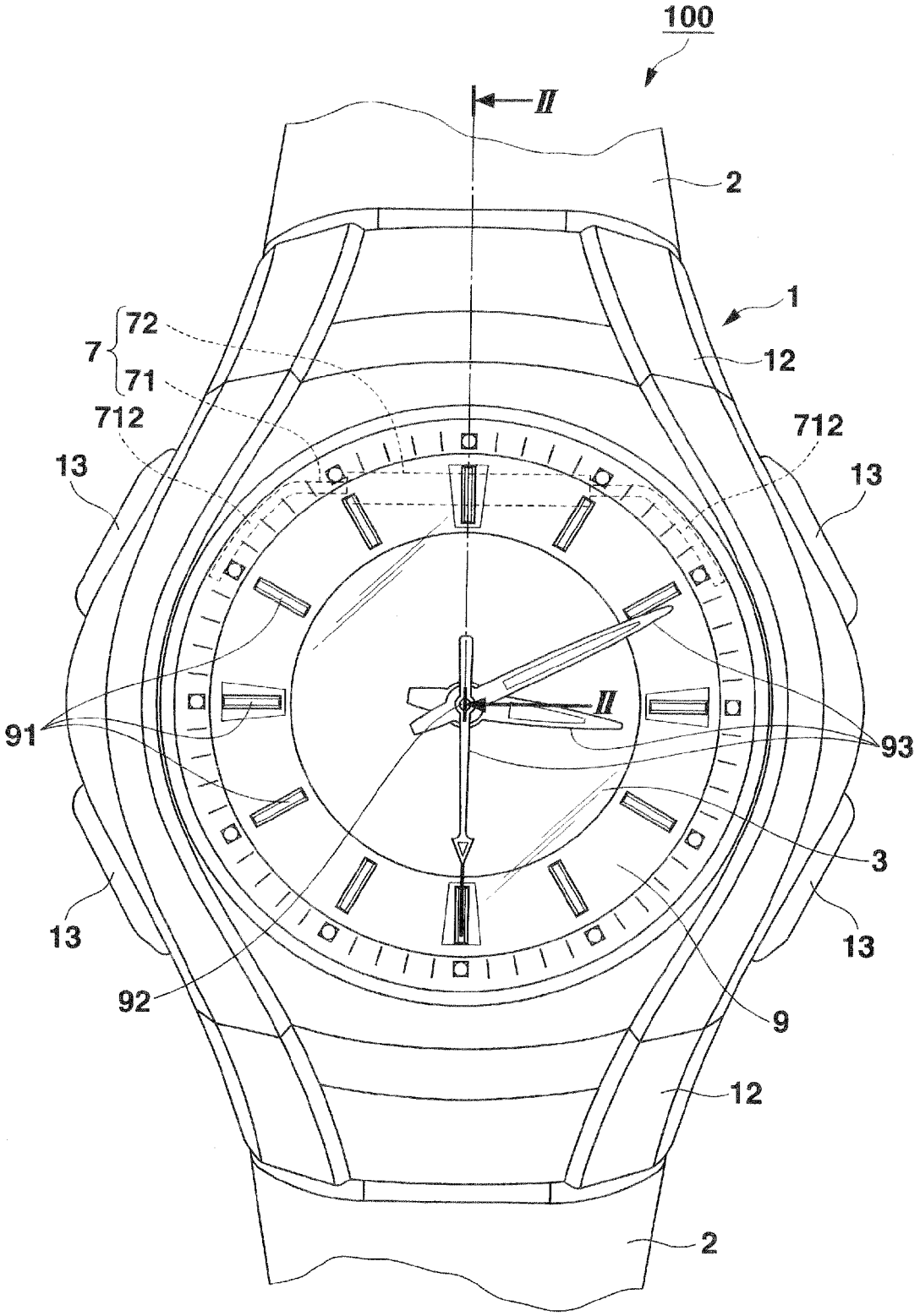
FIG. 1 is a front view of a radio-wave controlled wristwatch with an antenna device as a first embodiment of the present invention.
Figure 2:
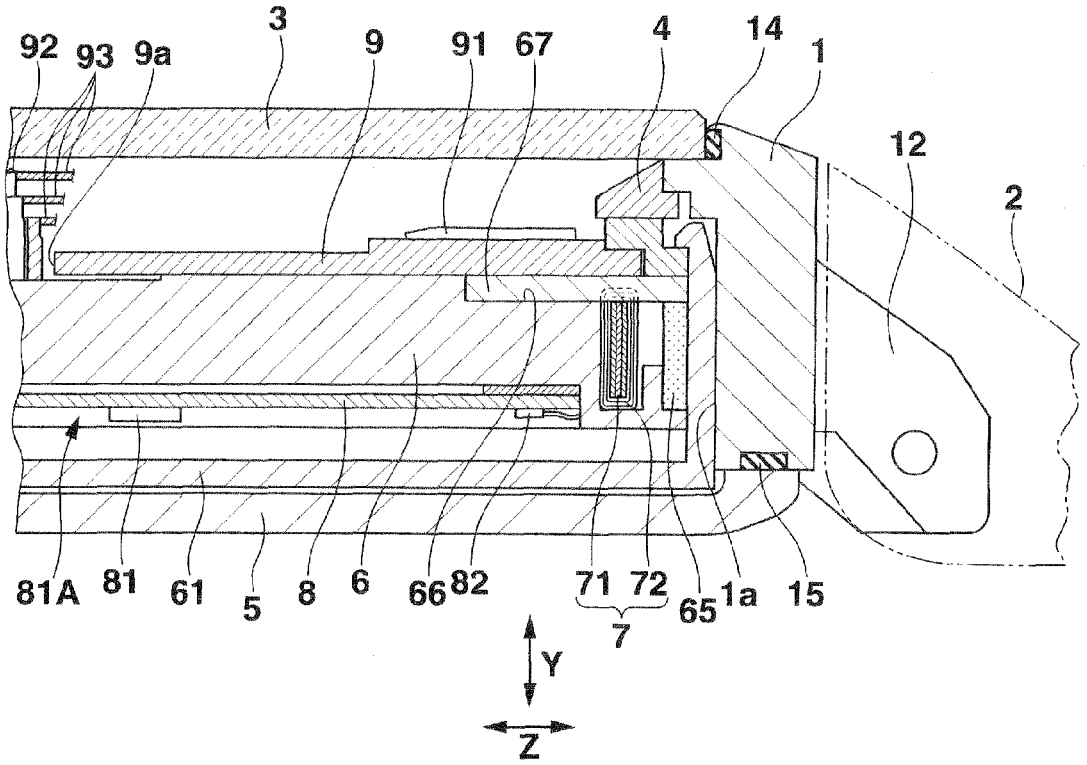
FIG. 2 is a cross-sectional view taken along the line II-II of FIG. 1.
Figure 3:
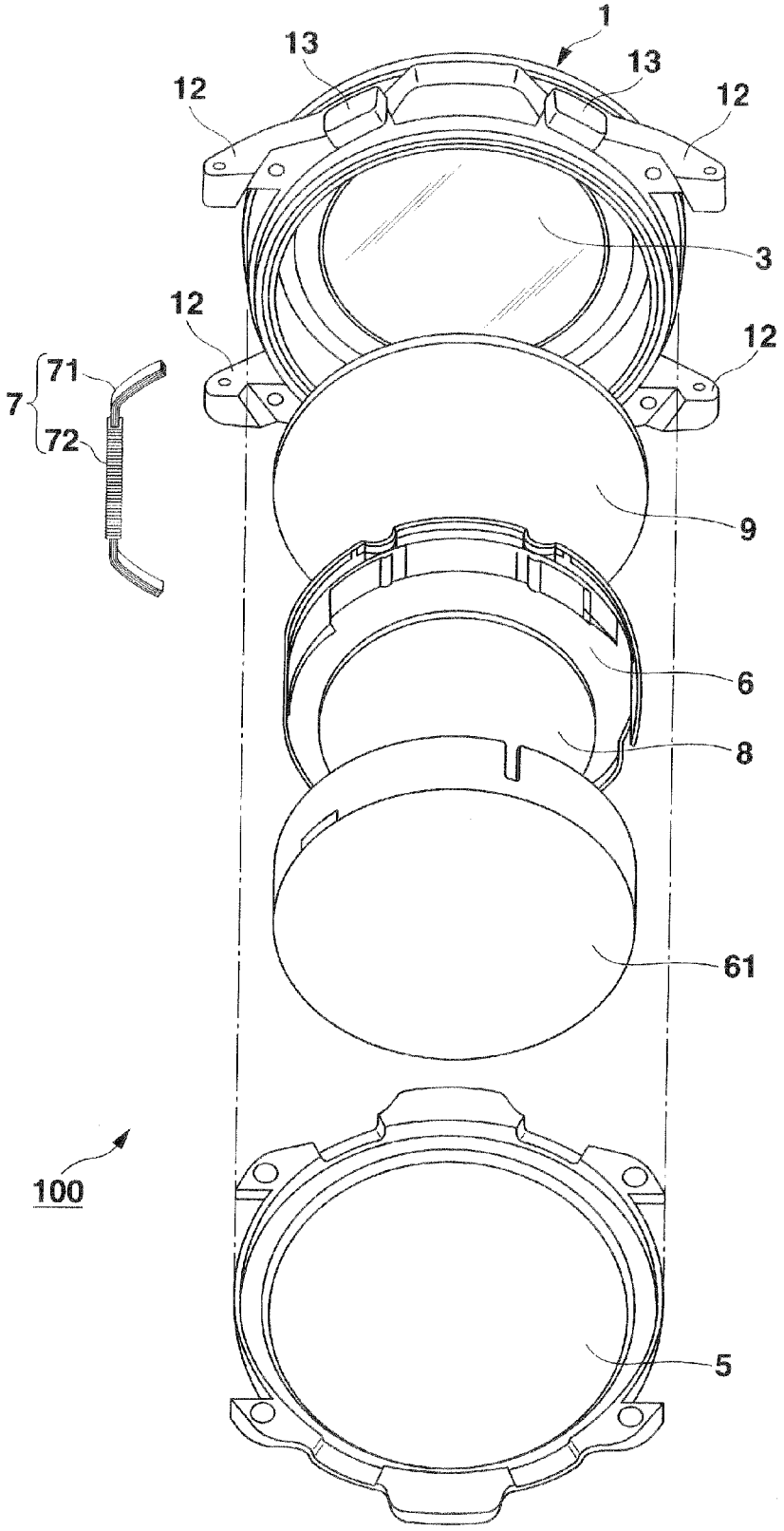
FIG. 3 is an exploded perspective view of the wristwatch of FIG. 1.

FIG. 1 is a front view of the radio-wave controlled wristwatch with the antenna device according to the present invention. FIG. 2 is a cross-sectional view taken along the line II-II in FIG. 1. FIG. 3 is an exploded perspective view of the wristwatch of FIG. 1.

As shown in FIGS. 1-3, the wristwatch 100 includes an annular case 1 of an electrical-conductive material such as stainless steal or titanium.

A shown in FIG. 1, the case 1 has wristband attachment lug pairs 12 (FIG. 2) provided at 12 and 6 o'clock positions on the wristwatch. A plurality of operation buttons 13 is provided along the outer periphery of the case 1 to issue commands including a time set one.

As shown in FIG. 2, an upper viewing-side end of the case 1 is covered with a non-conductive transparent glass member 3 through a waterproof ring 14. A ring-like panel cover 4 is disposed within and concentrically with the inner periphery of the case 1 below the glass member 3.

The case 1 is closed at its lower end with a back cover 5 of an electrical-conductive material such as stainless steal or titanium through a waterproof ring 15.

A disc-like non-metal (for example, synthetic resin) module member 6 is provided within the case The module member 6 contains antenna structure 7; timepiece movement (not shown) to perform the time functions; and an electronic part holder 81A which holds thereon a battery (not shown) to feed power to respective associated elements of the wristwatch 100, a circuit board 8 and other various electronic parts 81. It also has an antenna mounting area 62 where the antenna structure 1 is mounted.

The circuits provided on the circuit board 8 include a control IC such as a CPU which controls associated elements of the wristwatch 100, a receiving circuit which amplifies and demodulates an electrical signal detected by the antenna structure 7, thereby providing time data included in the standard radio waves, and a time counter (not shown) which includes an oscillator, thereby counting a current time.

The module member 6 is supported by a support member 61 from the back side of the wristwatch 100 and secured within the case 1. The support member 61 is not indispensable one, but the module member 6 may be directly supported by the back cover 5 without using the support member 61.

A dial 9 is disposed within the case 1 below the glass member 3 as shown FIG. 2. As shown in FIG. 1, the dial 9 has 12 hour marks 91 indicating 1, 2, 3, . . . 12 o'clock positions provided at substantially equi-spaced intervals along the periphery thereof.

A hand stem 92 extends through a center hole 9*a* on the dial 9. Hour, minute and seconds hands 93 are attached to the hand stem 92 between the glass member 3 and the dial 9 so as to be driven above the dial 9 around the stem 92.

Figure 4:
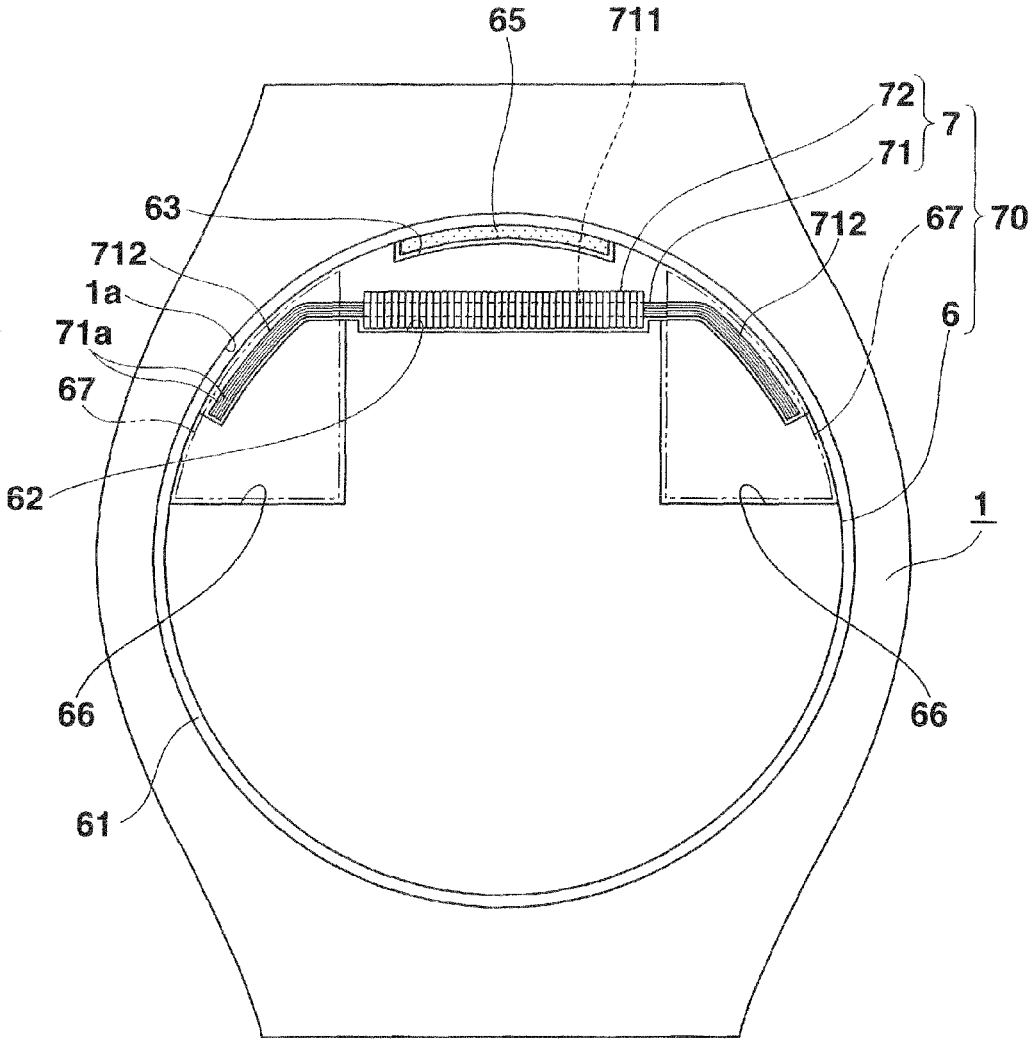
FIG. 4 is a plan view of the wristwatch of FIG. 1 with a glass cover and dial removed.
Figure 5:
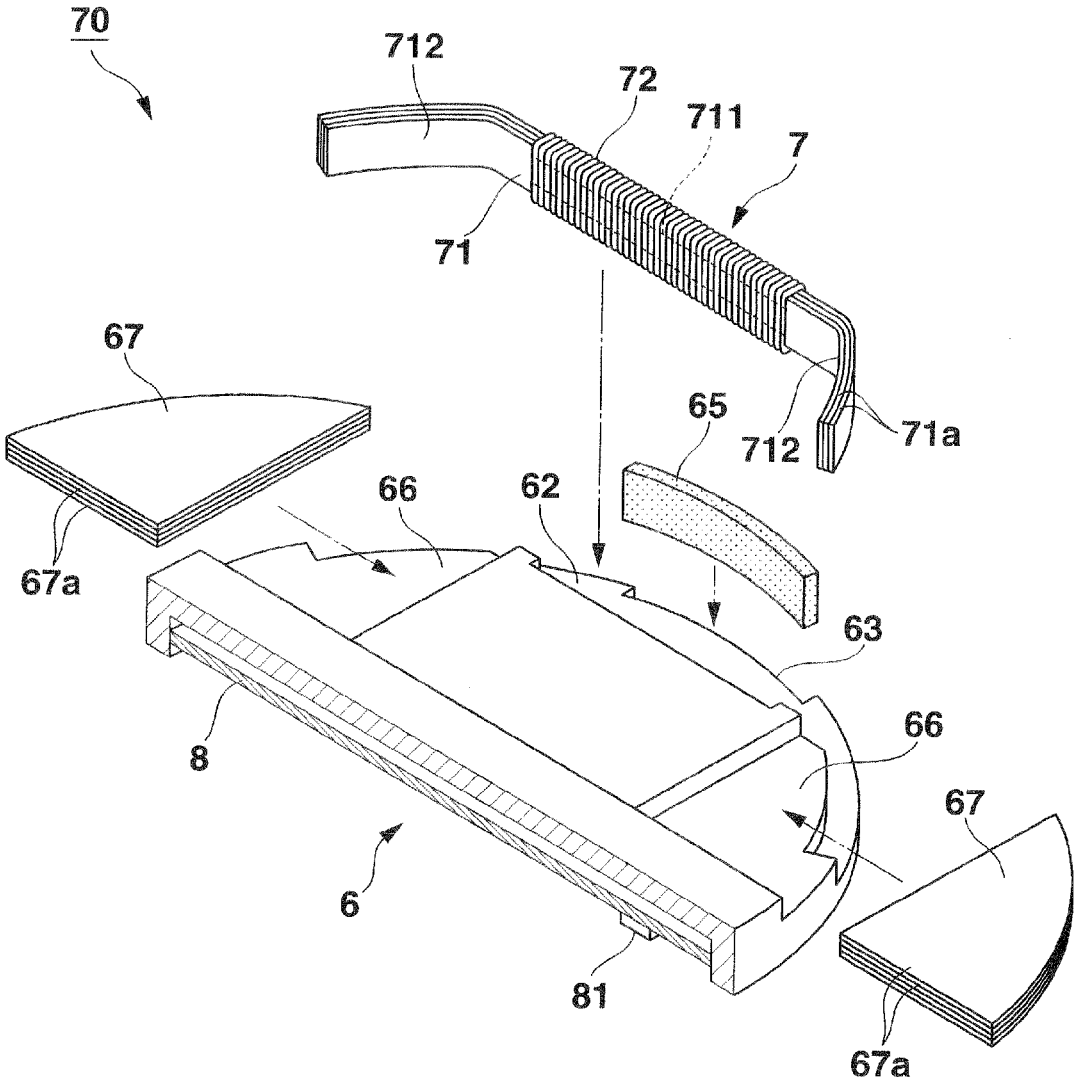
FIG. 5 is an exploded perspective view of an essential part of the wristwatch of FIG. 1.

Referring to FIGS. 4 and 5, the antenna structure 7 and the module member 6 in this embodiment will be described.

As shown in FIGS. 4 and 5, the antenna structure 7 includes an elongated core 71 and a coil 72 wound around the core 71 such that when radio waves pass through the core 71, a voltage is induced across the coil 72 due to changes in the magnetic flux linking with the coil 72. Wire ends of the coil 72 are electrically connected to terminals 82 (FIG. 2) provided on the circuit board 8 such that the voltage signal obtained in the coil 72 is sent to the receiver circuit on the circuit board 8.

The core 71 is made of a plurality of strip-like magnetic layers 71*a* layered on the module member 6 in a direction perpendicular to the thickness direction of the module member 6 or the wristwatch 100 or in the direction of a double headed arrow Y in FIG. 2. Preferably, the plurality of strip-like magnetic layers 71*a* is secured together with adhesive so as to maintain its layered state.

Each layer 71*a* is made of a magnetic material of a high magnetic permeability $\mu$ ($\mu$ is a constant of proportion when a relationship between a strength of magnetic field H and a magnetic flux B is shown by $B=\mu H$) or of a high relative magnetic permeability $\mu s$ ($=\mu/\mu 0$; where $\mu 0$ is the magnetic permeability in a vacuum) such as an amorphous alloy.

However, the material forming the core 71 is not limited to the amorphous alloy, and another magnetic material which is formable to a thin plate may be used to form the core 71.

As shown in FIGS. 4 and 5, the core 71 has a central straight part 711 around which the coil 72 is wound and both bent end portions 712 each extending outward along the inner periphery of the case 1. It is to be noted that the shape of the bent end portions 712 is not limited to the illustrated one, but only one of both end portions of the core may be bent.

As described above, the central part 711 is straight such that the coil 72 is easily wound around the central part 711.

Each end portion 712 is also bent so as to extend along between the inner periphery of the case 1 and the outer periphery of the module member 6.

When the antenna structure 7 is disposed on the Module member 6, the bent end portions 712 are flush with a pair of magnetic flux collector mounting areas 66 on the module member 6, to be described later in more detail.

Thus, when the pair of magnetic flux collectors 67 are mounted on the pair of magnetic flux collector mounting areas 66, the pair of magnetic flux collectors 67 contacts the corresponding upper edges of the underlying pair of bent end portions 712, thereby establishing magnetic coupling between the magnetic flux collectors 67 and the corresponding end portions 712.

The module member 6 has an antenna mounting area 62 thereon at a 12 o'clock position on the wristwatch 100 where the antenna structure 7 is mounted when the module member 6 is disposed within the case 1.

The module member 6 has on a side a curved recess 63, where a curved magnetic member 65 is disposed for prevention of occurrence of eddy currents, outside the coil 72 of the antenna structure 7 disposed on the antenna mounting area 62 of the module member.

The size, shape and location of the recess 63 and magnetic member 65 are not limited to the illustrated ones. The material of the magnetic member 65 is, for example, ferrite stainless steel such as SUS 444; pure iron; stainless steal containing ferrite or permalloy powder; synthetic resin containing amorphous alloy or ferrite powder, etc. The materials of the magnetic member 65 are not limited to the illustrated ones.

As described above, the module member 6 has the pair of sectorial magnetic flux collector mounting recesses 66 thereon, which is formed adjacent to the respective bent end portions 712 of the antenna core 71 disposed on the antenna mounting area 62 of the module member 6.

The pair of magnetic flux collectors 67 made of a magnetic material, for example, of an amorphous alloy is disposed on the pair of recesses 66. Each magnetic flux collector 67 is made of late-like magnetic layers 67*a* layered in a direction perpendicular to a flat surface of the module member 6 or in the thickness direction of the wristwatch 100 shown by the double-headed arrow Z of FIG. 2.

The layers 67*a* of each magnetic flux collector 67 are preferably secured together with adhesive so as to maintain the layered state thereof.

The size and shape of each magnetic flux collector 67 and its mounting area 66 are not limited to the illustrated ones. Each magnetic flux collector 67 may be made of any magnetic material. The magnetic flux collector 67 to be used is not limited to the illustrated one of the plurality of layered strip-like magnetic layers 67*a*.

Also, the structure of each magnetic flux collector 67 is not limited to the illustrated one. Also, the material of each magnetic flux collector 67 may include, for example, ferrite stainless steel such as SUS 444, pure iron, stainless steel containing powder of ferrite or permalloy, or synthetic resin containing powder of a magnetic material such as amorphous alloy or ferrite.

As shown in FIG. 4, in the embodiment, the antenna structure 7, module member 6 and the pair of magnetic flux collectors 67 compose an antenna device 70.

Next, the fabricating method of the antenna device 70 and the radio-wave controlled wristwatch 100 including the antenna device 70 according to this embodiment will be described. First, when the radio-wave controlled wristwatch 100 is constructed, the antenna structure 7 is disposed in the antenna mounting recess 62 on the module member 6; the magnetic member 65 is disposed in the magnetic member mounting recess 63 between the case 1 and the antenna coil 72; and then the pair of magnetic flux collectors 67 is disposed in the pair of magnetic flux collector mounting recesses 66 on the module member 6.

Each bent end portion 712 of the core 71 is magnetically coupled to a respective one of the corresponding overlying magnetic members 67. Then, the module member 6 is supported by the support member 61 and disposed within the case 1. Then, the back cover 5 is fitted into the lower end of the case 1 for closing purpose.

In operation, when the standard radio waves are received, the magnetic components of the radio waves enter one of the pair of magnetic flux collectors 67 coupled with the antenna core 71 through the non-conductive glass member 3 and dial 9.

Then, the magnetic flux entering that magnetic flux collector is guided through a nearby one of the bent end portions 712 of the core 71 disposed on that magnetic flux collector 67, the core part present within the coil 72, and the other bent end portion of the core 71 to the other magnetic flux collector 67.

In this case, changes in the magnetic flux linking with the coil 72 wound around the core 71 induce an AC voltage across the coil 72. This AC voltage is delivered as an analog signal to a receiver circuit (not shown) provided on the circuit board 8. The receiver circuit amplifies, demodulates and decodes the signal, thereby providing digital time data, which is then used to set a current time of the wristwatch 100.

As described above, according to the embodiment, the antenna structure 7, which includes the antenna core 71 made of strip-like magnetic layers 71*a* layered in a direction, shown by the double-headed arrow Z of FIG. 2, perpendicular to the thickness direction of the module member 6 or wristwatch 100, is disposed in the antenna mounting recess 62 on the plate-like module member 6 near the 12 o'clock position of the wristwatch 100.

Both end portions 712 of the core 71 are bent so as to extend along the inner periphery of the case 1. Thus, the antenna structure 7 is disposed within a limited inner space of the case 1 in a compact manner.

When the antenna structure 7 is disposed in the antenna mounting recess 62 on the module member 6 and the pair of magnetic flux collectors 67 is disposed in the pair of magnetic flux collector mounting recesses 66 on the module member 6, both the bent end portions 712 of the antenna core 71 are magnetically coupled with the respective ones of the pair of magnetic flux collectors 67, which substantially extends the length of the core 71 and secures a wide area of the core 71.

Therefore, even when the core 71 itself is not large, the magnetic flux is collected efficiently. Thus, the antenna device 70 and the radio-wave controlled wristwatch 100 including the antenna device 70 are provided in a small size. Also, the antenna device 70 of high reception sensitivity is provided.

The coil 72 is wound around the central straight part 711 of the elongated core 71, and not around a curved core part. Thus, the coil 72 is easily wound equally around the central part 711.

The pair of magnetic flux collectors 67 is made of layered strip-like magnetic layers 67*a*, which contributes to collection of magnetic flux efficiently.

The magnetic member 65 is disposed between the antenna structure 7 and the case 1 for preventing generation of eddy currents. Thus, although the case is made of conductive material, the magnetic flux generated by the antenna structure 7 is guided to the magnetic member 65.

As a result, the magnetic flux generated by the antenna structure 7 is prevented from flowing into the conductive case 1, which would otherwise cause eddy currents. Thus, the reception sensitivity of the antenna structure 7 is improved.

(Second Embodiment)

Then, referring to FIGS. 6-8, a second embodiment of the antenna device and radio-wave receiver of the present invention will be described. The present embodiment is different from the first embodiment only in a structure in which the antenna structure and the magnetic member are provided on the module member, which will be described next.

Figure 6:
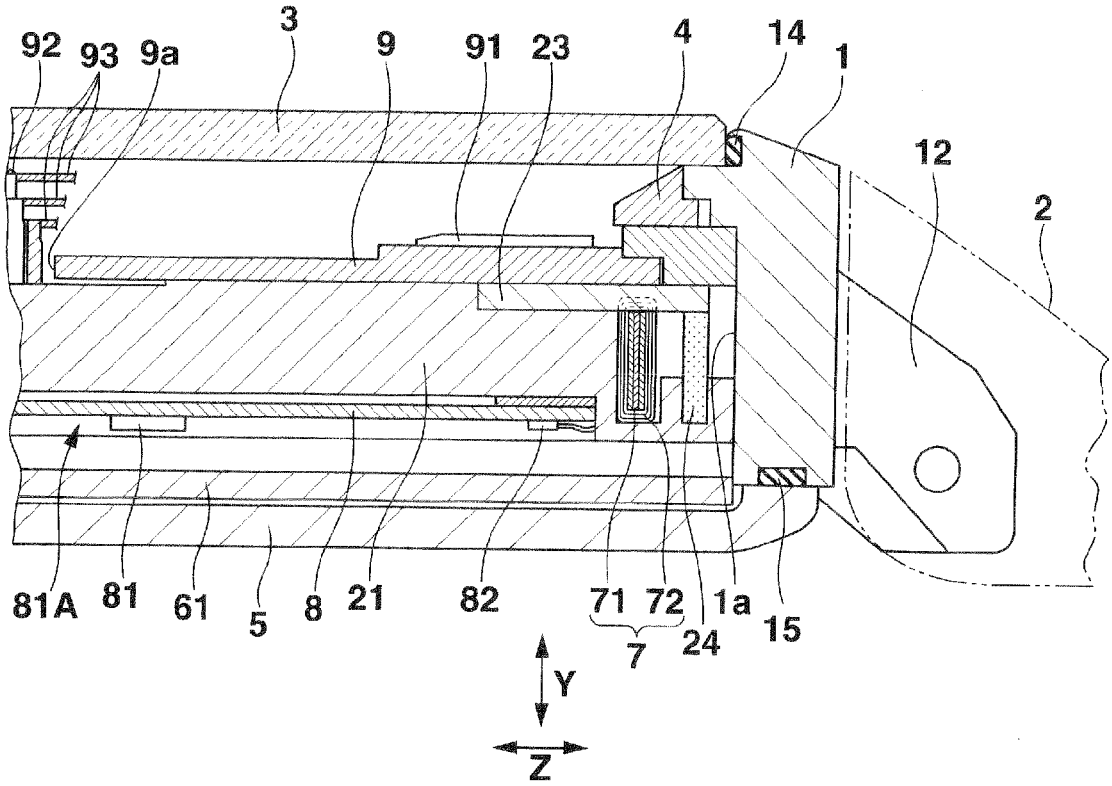
FIG. 6 is a sectional view of an essential portion of a radio-wave controlled wristwatch with an antenna device as a second embodiment of the present invention.
Figure 7A:
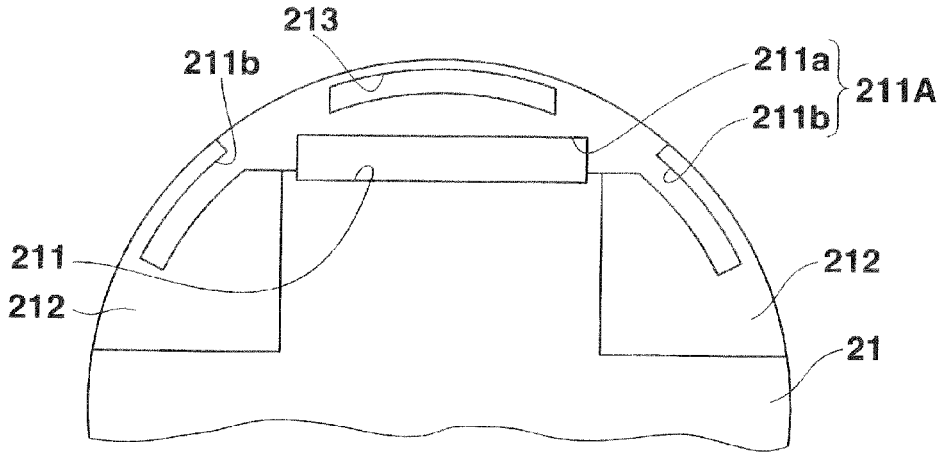
FIG. 7A is a plan view of a module member provided in the wristwatch of FIG. 6.
Figure 7B:
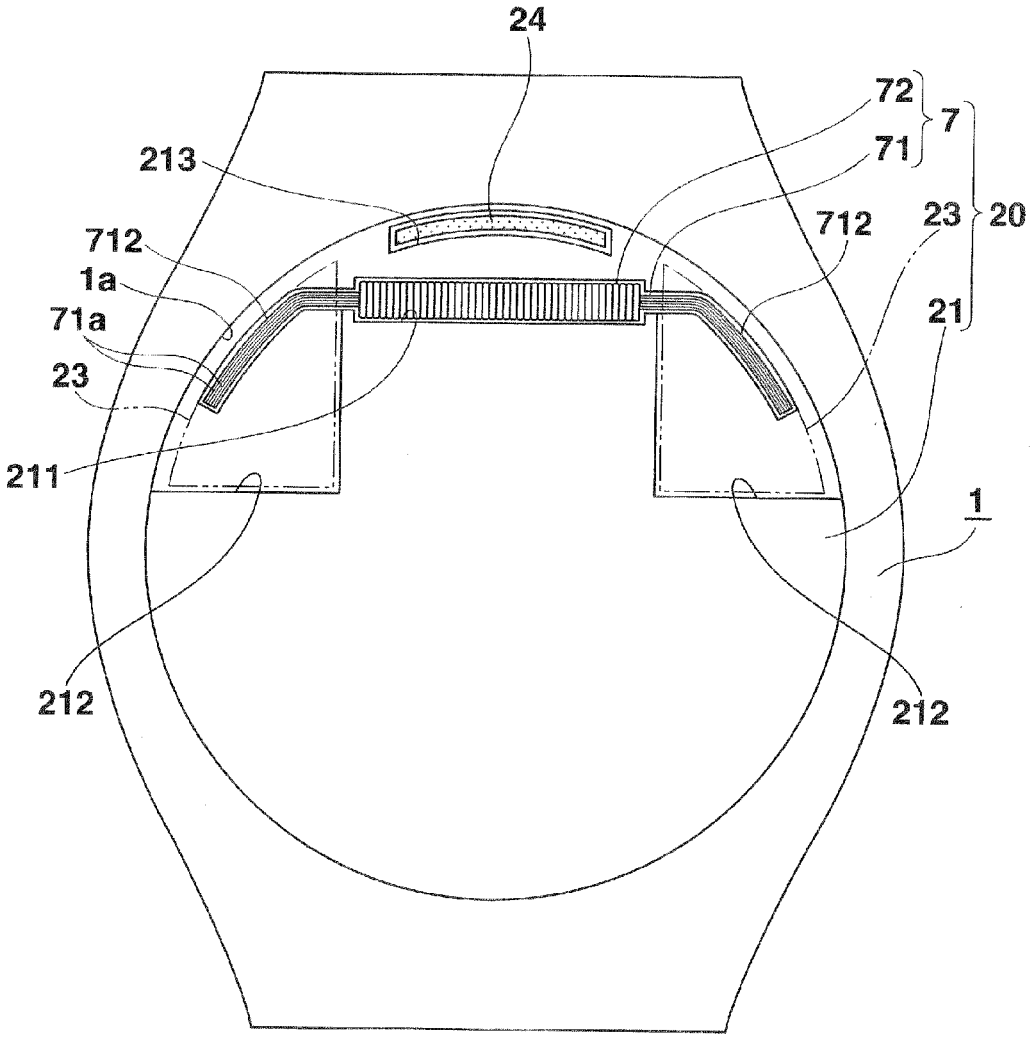
FIG. 7B is a plan view of the wristwatch showing the module member of FIG. 7A where an antenna structure, a pair of magnetic flux collectors and a magnetic member are provided.

FIG. 6 is a cross-sectional view of an essential portion of the radio-wave controlled wristwatch of the embodiment. FIGS. 7A and 7B are respectively plan views of a part of a module member and the wristwatch with several parts removed. FIG. 8 is an exploded perspective view of the essential portion of the wristwatch.

Figure 8:
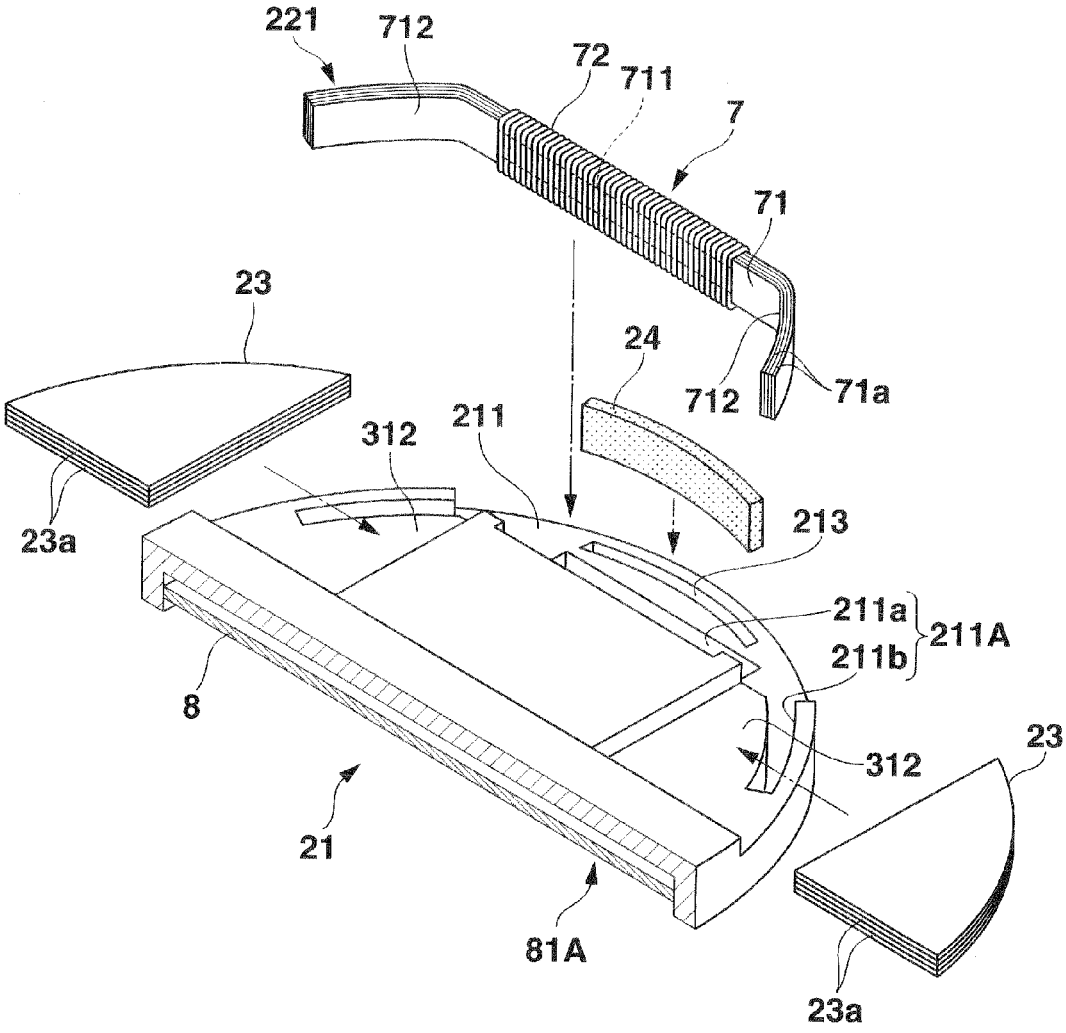
FIG. 8 is a partly exploded perspective view of the radio-wave controlled wristwatch of FIG. 6.

As shown in FIGS. 6-9, in the present embodiment, the antenna structure 7 includes an elongated core 71 and a coil 72 wound around the core as in the first embodiment. As shown in FIG. 8, the core 71 is made of a plurality of strip-like magnetic layers 71*a* layered in a direction perpendicular to the thickness direction of the module member 21 or the wristwatch.

The core 71 has a central straight part 711 around which the coil 72 is wound, and both and portions 712 bent so as to extend along between the outer periphery of the module member 21 and the inner periphery of the annular case 1.

As shown in FIG. 7A, the module member 21 has an antenna mounting area 211 thereon at the 12 o'clock position on the wristwatch where the antenna structure 7 is mounted. The antenna mounting area 211 is near the outer periphery of the module member 21 and has a groove 221A of a predetermined depth which conforms to the shape of the antenna structure 7.

The groove 211A has a central coil reception recess 211*a* where the coil 72 is accommodated and both recessed areas 211*b* provided on opposite sides of the coil reception recess 211*a* for accommodating the bent end portions 712, respectively, of the antenna core 221.

A pair of sectorial magnetic flux collector mounting recesses 212 each is formed adjacent to a respective one of end portions of the core 71 of the antenna structure 22 when the antenna structure 7 is accommodated in the antenna area 211.

As shown in FIG. 6, the bent end portions 712 of the antenna core 71 accommodated on the antenna area 211 are substantially flush with the bottom surface of the magnetic flux collector recesses 212 such that when the pair of magnetic flux collectors 23 is disposed on the pair of areas 212, the lower surfaces of the magnetic flux collectors 23 are magnetically coupled respectively to the upper edges of the bent end portions 712 of the core 71.

The module member 21 also has a magnetic member mounting recess 213, where the magnetic member 24 for preventing occurrence of eddy currents is disposed, near the outer periphery thereof at a position outside the coil 72 of the antenna structure 22 when the same is disposed on the antenna area 211.

As shown in FIG. 7B, like the first embodiment, the antenna device 20 of this second embodiment includes the module member 21, the antenna structure 7 and the pair of magnetic flux collectors 23.

The remaining structural parts of the antenna device 20 and the radio-wave controlled wristwatch are similar to those of the first embodiment. Thus, like reference numerals are used to denote like parts in the drawings and further description thereof will be omitted.

Next, the fabricating method of the antenna device 20 and the radio-wave controlled wristwatch including the antenna device 20 according to this embodiment will be described. First, when the radio-wave controlled wristwatch is constructed, the antenna structure 7 is disposed in the antenna mounting recess 62 on the module member 21; the magnetic member 24 for prevention of generation of eddy currents is disposed in the magnetic member mounting recess 213 between the case 1 and the antenna coil 72; and then the pair of magnetic flux collectors 23 is disposed in the pair of magnetic flux collector mounting recesses 212 on the module member 21.

Each bent end portion 712 of the core 71 is magnetically coupled to a respective one of the overlying magnetic members 23. Then, the module member 21 is supported by the support member 61 and disposed within the case 1. Then, the back cover 5 is fitted into the lower end of the case 1 for closing purpose.

In operation, when the wristwatch receives standard radio waves, the magnetic components of the radio waves enter the pair of magnetic flux collectors 23 coupled with the antenna core 71 through the non-conductive glass member 3 and dial 9.

Then, the magnetic flux entering the pair of magnetic flux collectors 23 is guided through the respective bent end portions 712 of the core 71 disposed on the pair of magnetic flux collectors 23 to the core part within the coil 72.

In this case, changes in the magnetic flux linking with the coil 72 induce an AC voltage across the coil 72. This AC voltage is delivered as an analog signal to a receiver circuit (not shown) provided on the circuit board 8. As in the first embodiment, a current time is set based on time data included in the analog signal.

As described above, according to the embodiment, the antenna structure 7, which includes the antenna core 71 made of strip-like magnetic layers 71*a* layered in a direction perpendicular to the thickness direction of the module member 21, is disposed in the antenna mounting recess 211 on the plate-like module member 21 near the 12 o'clock position on the wristwatch. Further, both the end portions 712 of the core 71 are bent so as to conform to the inner periphery of the case 1. Thus, the antenna structure 7 is disposed within a limited inner space of the case 1 in a compact manner.

When the antenna structure 7 is disposed in the antenna mounting recess 211 on the module member 21 and the pair of magnetic flux collectors 23 is disposed in the pair of magnetic flux collector mounting recesses 212 on the module member 21, both the bent end portions 712 of the antenna core 71 are magnetically coupled with the respective ones of the pair of magnetic flux collectors 23, which substantially extends the length of the core 71 and widens the area of the core 71 by the total area of the pair of magnetic flux collectors 23.

Therefore, even when the core 71 itself is not large, the magnetic flux is collected efficiently. Thus, the antenna device 20 and the radio-wave controlled wristwatch including the antenna device 20 are provided in a small size. Also, the antenna device 20 of high reception sensitivity is provided.

The antenna mounting recess 211 includes grooves 211*b* near the outer periphery of the module member 21 where the core 71 is disposed. Thus, the both end portions of the elongated core 71 are disposed within the corresponding grooves 211*b*. Therefore, although the core 71 is made of strip-like layered magnetic layers 71*a*, the core 221 is held so as not to come apart. Thus, the core 71 is secured rapidly and securely on the module member 21 without holding the core 71 within the resin antenna case.

Since the magnetic member 24 is disposed between the antenna structure 7 and the case 1, magnetic flux emerging from both ends of the coil 222 are guided toward the magnetic member 24 without turning back to the metal case 1, thereby preventing generation of eddy currents on the metal case 1 and improving the reception sensitivity of the antenna structure 22.

(Third Embodiment)

Then, referring to FIGS. 9-10, a third embodiment of the antenna device and radio-wave receiver of the present invention will be described. The present embodiment is different from the first and second embodiments only in a structure in which the antenna structure and the magnetic member are provided on the module member, which will be described next.

Figure 9:
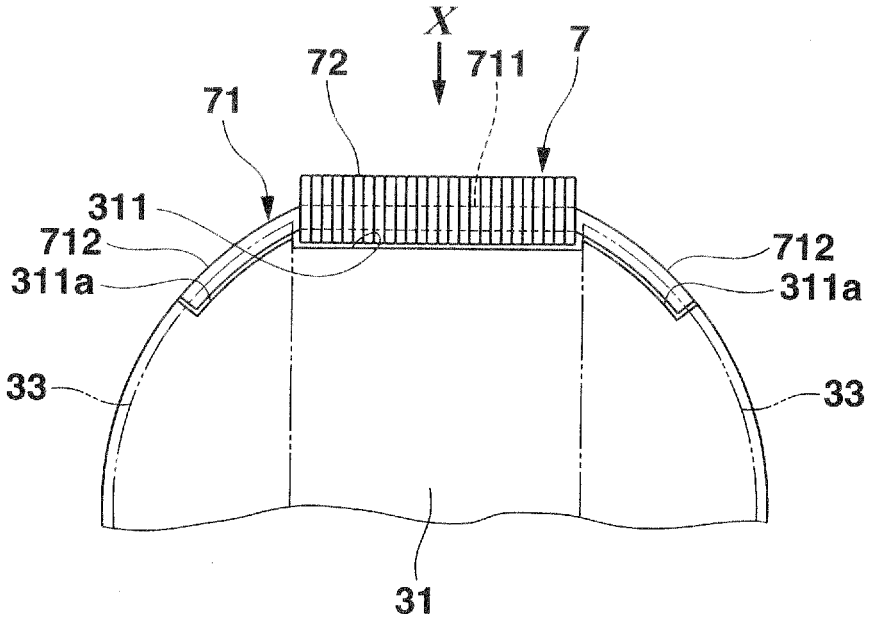
FIG. 9 is a plan view of an essential portion of an antenna device as a third embodiment of the present invention attached to a module member of the wristwatch.

FIG. 9 is a plan view of the module member as viewed from its front side. FIG. 10 is a side view of the antenna device as viewed in the direction of the arrow X of FIG. 9. In this embodiment, the antenna device 30 (see FIG. 10) comprises a module member 31, an antenna structure 32 and a pair of magnetic flux collectors 33 as in the first embodiment.

In the present embodiment, the antenna structure 32 includes an elongated core 71 and a coil 72 wound around the core as in the first and second embodiments. Although not shown, the core 71 is made of a plurality of strip-like magnetic layers layered in a direction perpendicular to the thickness direction of the module member 31 or the wristwatch.

The core 71 has a central straight part 711 around which the coil 72 is wound, and both end portions 112 bent so as to extend along between the outer periphery of the module member 21 and the inner periphery of the case 1.

Figure 10:
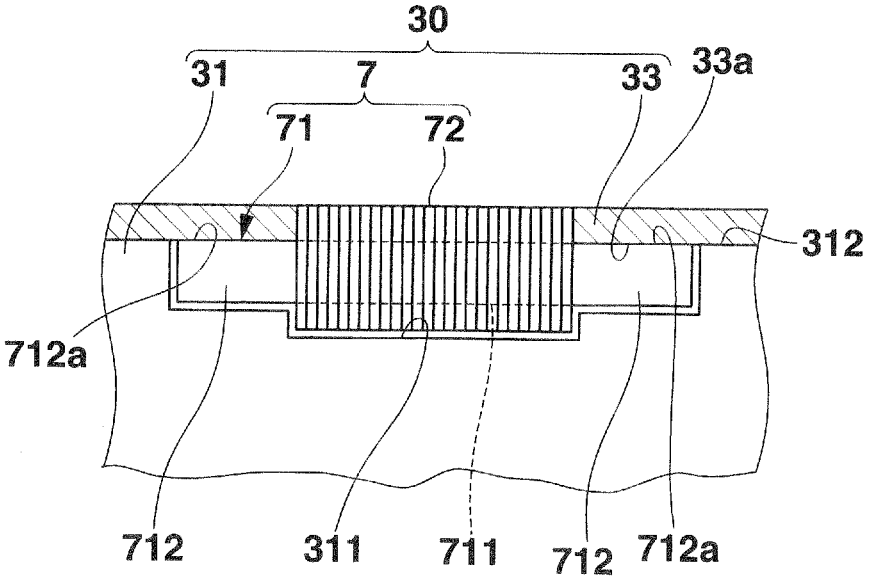
FIG. 10 is a side view of the antenna device as viewed in the direction of the arrow X of FIG. 9.

As shown in FIGS. 9 and 10, the module member 31 has an antenna mounting recess 311, where the antenna structure 32 is mounted, at the top of the outer periphery thereof at the 12 o'clock position side of the wristwatch. The antenna mounting area 311 has a pair of recess branches 311*a* provided on the outer periphery of the module member 31.

When the antenna structure 32 is mounted in the recess 311, both end portions of the core 71 are bent along the bottoms of the recess branches 311*a* of the recess 311 and then the antenna structure 32 is secured in the recess 311 and its recess branches.

A pair of sectorial magnetic flux collector mounting recesses 312 each is formed adjacent to a respective one of end portions of the core 71 of the antenna structure 22 when the antenna structure 32 is accommodated in the antenna recess 311.

As shown in FIG. 10, the antenna mounting recess 311 has such a depth that when the antenna structure 32 is disposed on the recess 311, the bent end portions 712 of the antenna core 71 are substantially flush at 712*a* with the bottom surface of the magnetic flux collector mounting recesses 312. Thus, when the pair of magnetic flux collectors 33 is disposed on the pair of areas 312, the lower surfaces 33*a* of the magnetic flux collectors 33 are magnetically coupled respectively to the upper edges 712*a* of the bent end portions 712 of the core 71.

The remaining structural portions of the antenna device 30 and the radio-wave controlled wristwatch of this embodiment are similar to those of the first and second embodiments, and further description thereof will be omitted.

Next, the fabricating method of the antenna device 30 and the radio-wave controlled wristwatch including the antenna device 30 will be described.

First, when the radio-wave controlled wristwatch is constructed, the antenna structure 32 is disposed in the antenna mounting recess 311 on the module member 31. Then, both the end portions 712 of the core 71 are bent so as to conform to the respective recess branches 311*a* of the antenna mounting recess 311 and then secured in the recess branches 311*a*. Further, the pair of magnet flux collectors 33 disposed on the pair of magnetic flux collector mounting recess 312.

Thus, in this resulting assembly, both the end portions 712 of the core 71 are magnetically coupled to the corresponding overlying magnetic flux collectors 33. Then, the module member 31 is supported by the support member 61 and disposed within the case 1. Then, the back cover is fitted into the lower end of the case 1 for closing purpose.

In operation, when the radio-wave controlled wristwatch receives the standard radio waves, the magnetic components of the radio waves enter the pair of magnetic flux collectors 33 coupled with the antenna core 71 through the non-conductive glass member 3 and dial 9.

Then, the magnetic flux is guided to the coil 72 wound around the core 71, thereby inducing an AC voltage across the coil 72 due to changes in the magnetic flux linking with the coil 72. Then, a current time is set based on time data included in the analog signal, which is the AC voltage.

As described above, according to the embodiment, the antenna structure 32, which includes the antenna core 71 made of the plurality of strip-like magnetic layers 71*a* layered in a direction perpendicular to the thickness direction of the module member 31, is disposed on the side of the plate-like module member 31.

Both end portions 712 of the core 71 are bent so as to conform to the inner periphery of the case 1. Thus, the antenna structure 32 is disposed within a limited inner space of the case 1 in a compact manner.

Since in this embodiment the elongated core 71 is disposed in the antenna mounting recess 311 formed on the outer periphery of the module member 31, the core 71 and other parts of the wristwatch are disposed wholly compactly in a limited space of the wristwatch.

When the antenna structure 32 is disposed in the antenna mounting recess 311 on the module member 31 and the pair of magnetic flux collectors 33 is disposed in the pair of magnetic flux collector mounting recesses 312 on the module member 31, both the bent end portions 712 of the antenna core 71 emerging from both the ends of the coil 72 are magnetically coupled with the respective ones of the pair of magnetic flux collectors 33, which substantially extends the length of the core 71 and ensures a wide area of the core 71.

Therefore, even when the core 71 itself is not large, the magnetic flux is collected efficiently. Thus, the antenna device 30 and the radio-wave controlled wristwatch including the antenna device 30 are provided in a small size. Also, the antenna device 30 of high reception sensitivity is provided.

(Fourth Embodiment)

Then, referring to FIGS. 11-11, a fourth embodiment of the antenna device and radio-wave receiver of the present invention will be described. The present embodiment is different from the first-third embodiments only in a structure in which the antenna structure and the magnetic member are provided on the module member, which will be described next.

Figure 11:
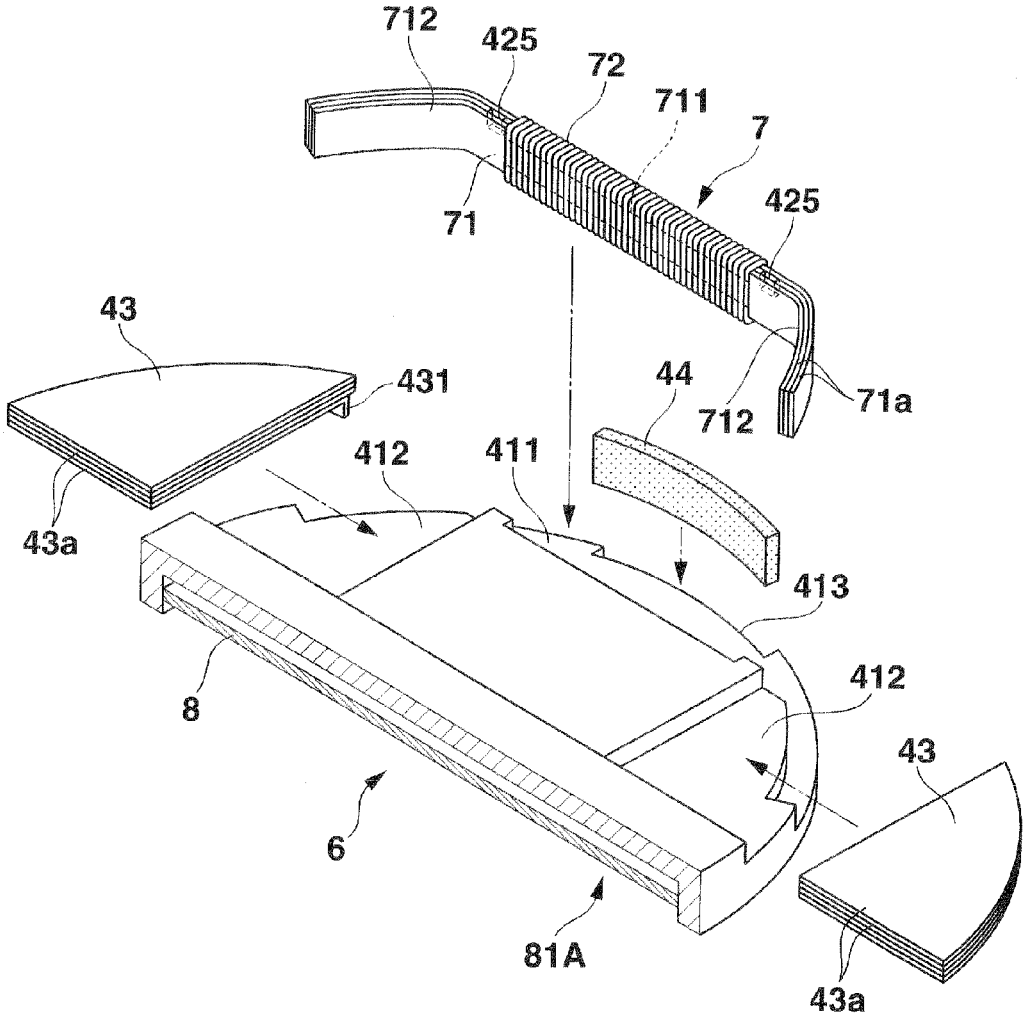
FIG. 11 is a view similar to FIG. 8 of an antenna device as a fourth embodiment of the present invention.

FIG. 11 is an exploded perspective view of an essential portion of the radio-wave controlled wristwatch. In this embodiment, the antenna device comprises a module member 6, an antenna structure 37 and a pair of magnetic flux collectors 43 as in the first-third embodiments.

In this embodiment, the antenna structure 7 includes an elongated core 71 and a coil 72 wound around a central straight part 711 of the core 71 as in the first-third embodiments. Both end portions 712 of the core 71 are bent so as to extend along between the outer periphery of the module member 6 and the inner periphery of the case 1.

Figure 12:
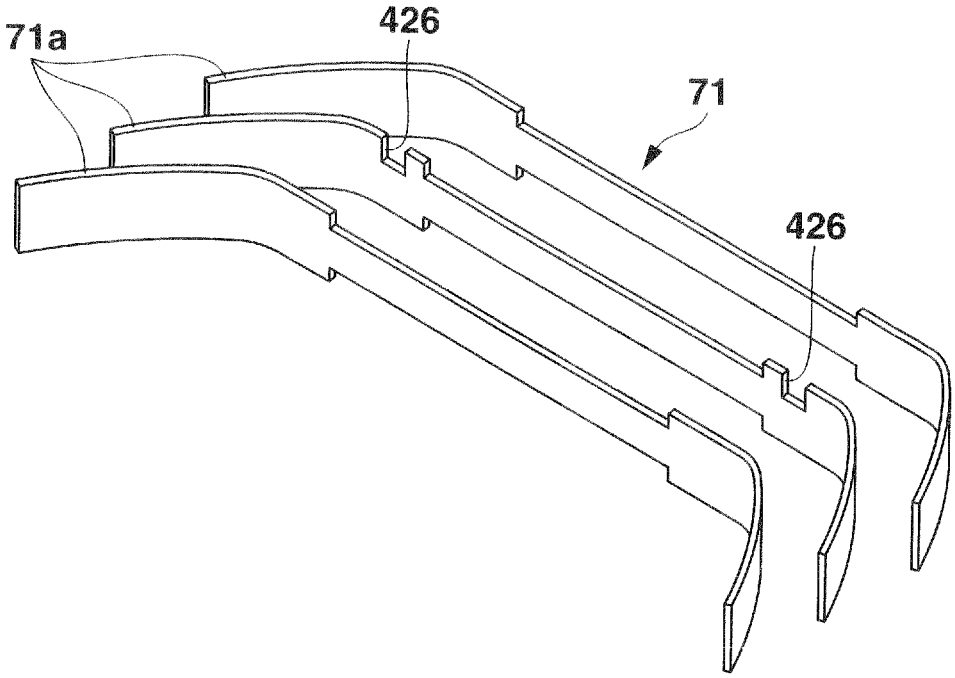
FIG. 12 is an exploded perspective view of a core of the antenna structure of FIG. 11.

As shown in FIGS. 11 and 12, the core 71 is made of a plurality of strip-like magnetic layers 71*a* layered in a direction perpendicular to the thickness direction of the module member 6 or the wristwatch.

In this embodiment, an inner one of the layered layers 71*a* has a pair of recesses 426 each on an upper edge of that layer near a respective one of the ends of the coil 72. As shown in FIG. 12, the inner layer and adjacent layers compose a pair of holes 425.

While in this embodiment the three layers 71*a* are illustrated as layered to compose the core 71 for convenience sake, the number of layers 71*a* composing the core 71 is not especially limited. Preferably, the layer 71*a* with the pair of recesses 426 is disposed between such layers, but its location is not especially limited.

A pair of sectorial magnetic flux collector mounting areas 412 where the pair of magnetic flux collectors 43 is each disposed is provided on the module member 6 adjacent to a respective one of the bent end portions 712 of the antenna core 71 when the antenna structure 712 is disposed in the antenna mounting recess 411.

Figure 13:
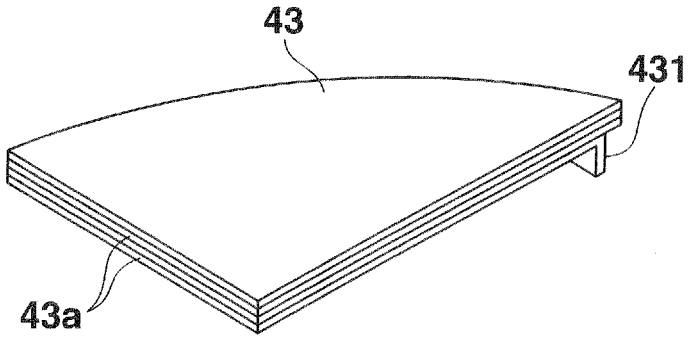
FIG. 13 is an enlarged view of one of a pair of magnetic flux collectors of the antenna device of FIG. 11.
Figure 14:
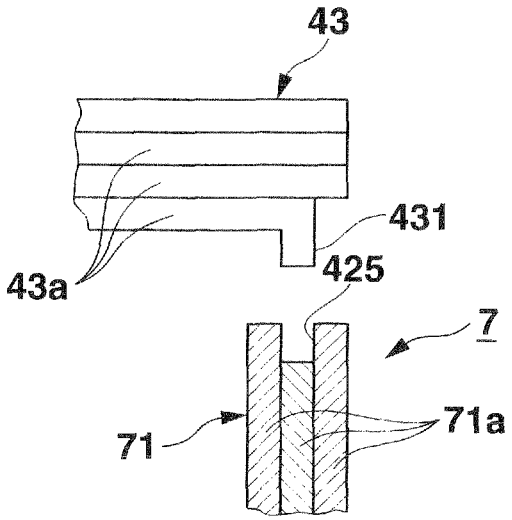
FIG. 14 illustrates fitting of the magnetic flux collectors of the antenna device to the core of the antenna structure of FIG. 11.

As shown in FIGS. 11 and 13, each magnetic flux collector 43 is made of a plurality of layered sectorial magnetic layers 43*a*. In this embodiment, the lowest one of the sectorial layers 43*a* of each magnetic flux collector 43 has a downward bend 431 near one end of the coil 72 on the antenna core 71 and fitting into a hole 425 including a recess 426 formed within the core 71 near that end of the coil 72 of the antenna structure 7 when same is disposed in the antenna mounting recess 411.

When the antenna structure 7 is disposed in the antenna mounting recess 411 and the pair of magnetic flux collectors 43 is disposed on the pair of magnetic flux collector mounting recesses 412, the respective downward bends 431 of the magnetic flux collectors 43 fit into the corresponding holes 425 in the core 421, thereby magnetically coupling the magnetic flux collectors 43 with the corresponding bent end portions 712 of the core 421.

The module member 6 has a recess 413 where the magnetic member 44 is disposed on the outer periphery thereof outside the coil 72 of the antenna structure 7 when the antenna structure 7 is disposed in the antenna mounting recess 411.

The remaining structural portions of the antenna device 40 and the radio-wave controlled wristwatch as the radio-wave receiver according to this embodiment are similar to those of the first-third embodiments and further description thereof will be omitted.

Next, the fabricating method of the antenna device 40 and the radio-wave controlled wristwatch including the antenna device 40 will be described. First, when the radio-wave controlled wristwatch is constructed, the antenna structure 7 is disposed in the antenna mounting recess 411 on the module member 31 and then the magnetic member 44 is disposed in the magnetic member mounting recess 413 between the case 1 and the antenna coil 72.

Then, the bend 431 of each of the magnetic flux collectors 43 is fitted into a respective one of the pair of holes 425 on the core 71 such that each bent end portion 712 of the core 71 is magnetically coupled with a corresponding magnetic flux collector 43. Then, the module member 6 is supported by the support member and disposed within the case 1. Then, the back cover is fitted into the lower end of the case 1 for closing purpose.

In operation, when the standard radio waves are received, the magnetic components of the radio waves enter the pair of magnetic flux collectors 43 through the non-conductive glass member and dial. Then, the magnetic flux is guided into the coil 72 wound around the core 71, thereby inducing an AC voltage across the coil 72. Then, this AC voltage is delivered as an analog signal to a receiver circuit (not shown). A current time is set based on time data included in the analog signal.

As described above, according to the embodiment, the antenna structure 7 includes the antenna core 71 made of strip-like magnetic layers 71*a* layered in the direction perpendicular to the thickness direction of the module member 6 or the wristwatch, and the coil 72 wound around the core 71. Thus, the core 71 and the other parts are disposed within a limited inner space of the case 1 in a compact manner.

When the antenna structure 7 is disposed in the antenna mounting recess 411 on the module member 21 and the pair of magnetic flux collectors 43 is disposed in the pair of magnetic flux collector mounting recesses 412 on the module member 21, the bent end portions 712 of the antenna core 71 emerging from both the ends of the coil 72 are magnetically coupled with the respective associated ones of the pair of magnetic flux collectors 43, which substantially extends the length of the core 71 and ensures a wide area of the core 71.

Therefore, even when the core 71 itself is not large, the magnetic flux is collected efficiently. Thus, the antenna device 40 and the radio-wave controlled wristwatch including the antenna device 40 are provided in a small size. Also, the antenna device 40 of high reception sensitivity is provided.

Since in this embodiment the bends 431 of the pair of magnetic flux collectors 43 fit into the respective ones of the pair of holes 425 in the core 71, the core 71 is securely combined with the respective bends 431.

The magnetic member 44 disposed between the antenna structure 7 and the case 1 serves to prevent generation of eddy currents, thereby improving the reception sensitivity of the antenna structure 7, although the case 1 is made of the conductive material.

While in the embodiment it is illustrated that one of the strip-like layers 71*a* of the antenna core 71 has a pair of recesses 426 on the edge thereof and that the lowest one of the layers 43*a* of each of the pair of sectorial magnetic flux collectors 43 has a downward bend 431, the number of layers 71*a* of the core 71 each with a pair of recesses 426 and the number of layers 43*a* composing each bend 431 are not limited to the illustrated example.

For example, adjacent ones of the strip-like layers 71*a* each may have a pair of recesses 426 and the lowest two of the layers 43*a* of each of the pair of magnetic flux collectors 43 may each have a bend 431 fitting into a corresponding one of recesses 426 composing an associated one of the pair of holes 425 provided in the core 71.

While in the above-mentioned respective embodiments the core of the antenna structure is illustrated as being composed of the plurality of layered strip-like magnetic layers whose end portions are bent so as to extend around the outer periphery of the module member, the core structure is riot limited to the illustrated one.

For example, when an antenna structure which includes a core of a plurality of layered straight strip-like magnetic layers around which core a coil is wound is disposed on the module member, the end portions of the core may be bent so as to extend around the outer periphery of the module member.

When the antenna structure 7 is disposed on the antenna mounting recess 211 as in the second embodiment, it is recommended that the core 71 is bent so as to conform partly to the inner configuration of the antenna mounting recess 211 and then that the core 71 is fitted into the antenna recess 211 because the shape of the core 71 is maintained without taking a great deal of time to glue the layers 71*a* together.

While in the respective embodiments the case is illustrated as circular, the case is not limited to the illustrated one. For example, the case may be square or polygonal. The antenna structure preferably takes a shape which conforms to the inner shape of the case so as to ensure as much space as possible within the case.

The materials of the module member may include, for example, ABS resin and vinyl chloride, and among them, especially include phenolic resin and epoxy resin most preferably, from the standpoint of heat resistance, dimension stability, and strength.

While in the respective embodiments the radio-wave controlled receivers which use the antenna device is illustrated as the radio-wave controlled wristwatch, the radio-wave receivers in which the inventive antenna device is usable are not limited to the illustrated ones. The inventive antenna structure may be applied to any radio-wave receivers which receive radio waves, using an antenna structure; for example, fixed type radio-wave controlled timepieces, small radios and the mobile terminals.

(Fifth Embodiment)

Figure 15:
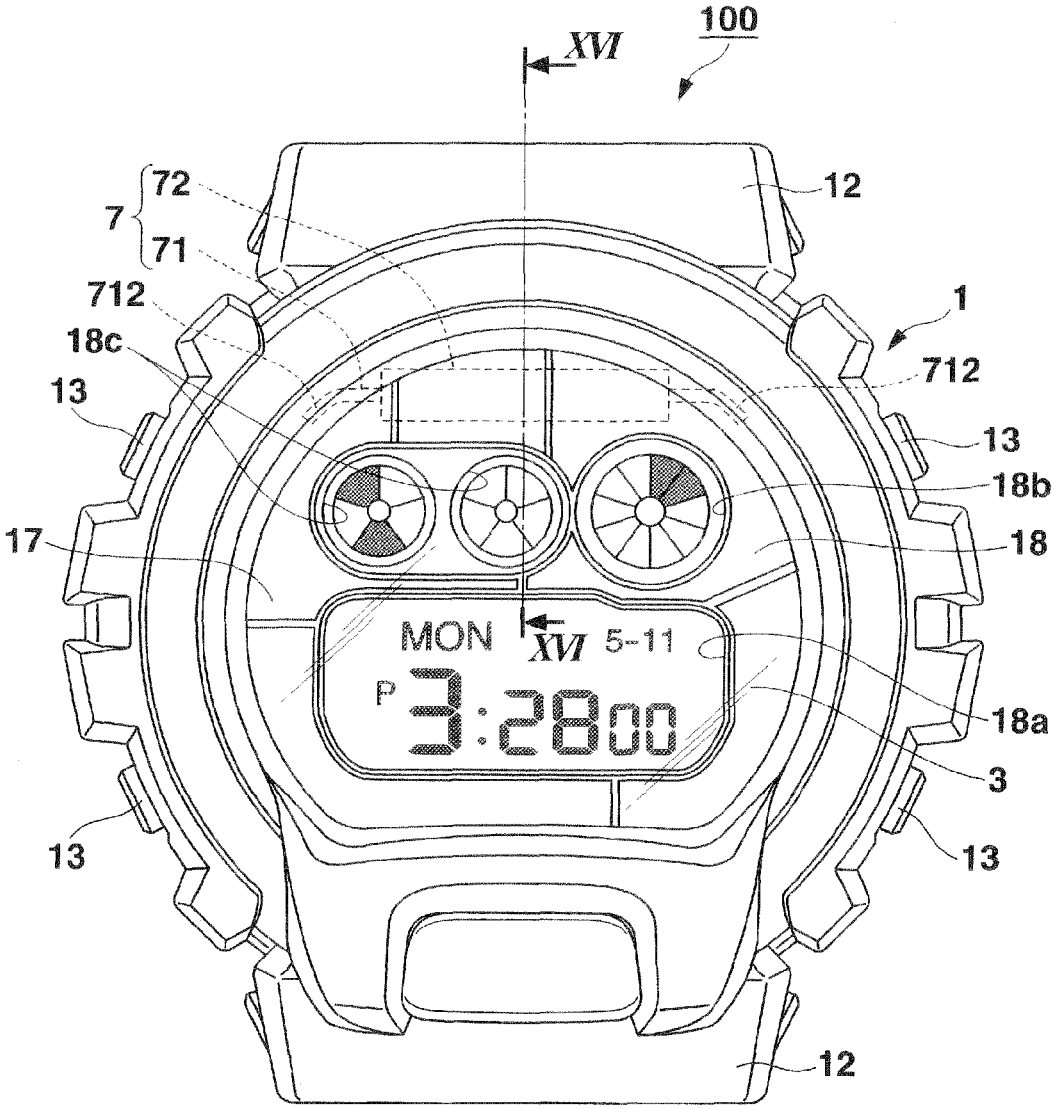
FIG. 15 is a schematic front view of a radio-wave controlled wristwatch with an antenna device according to a fifth embodiment of the present invention.
Figure 16:
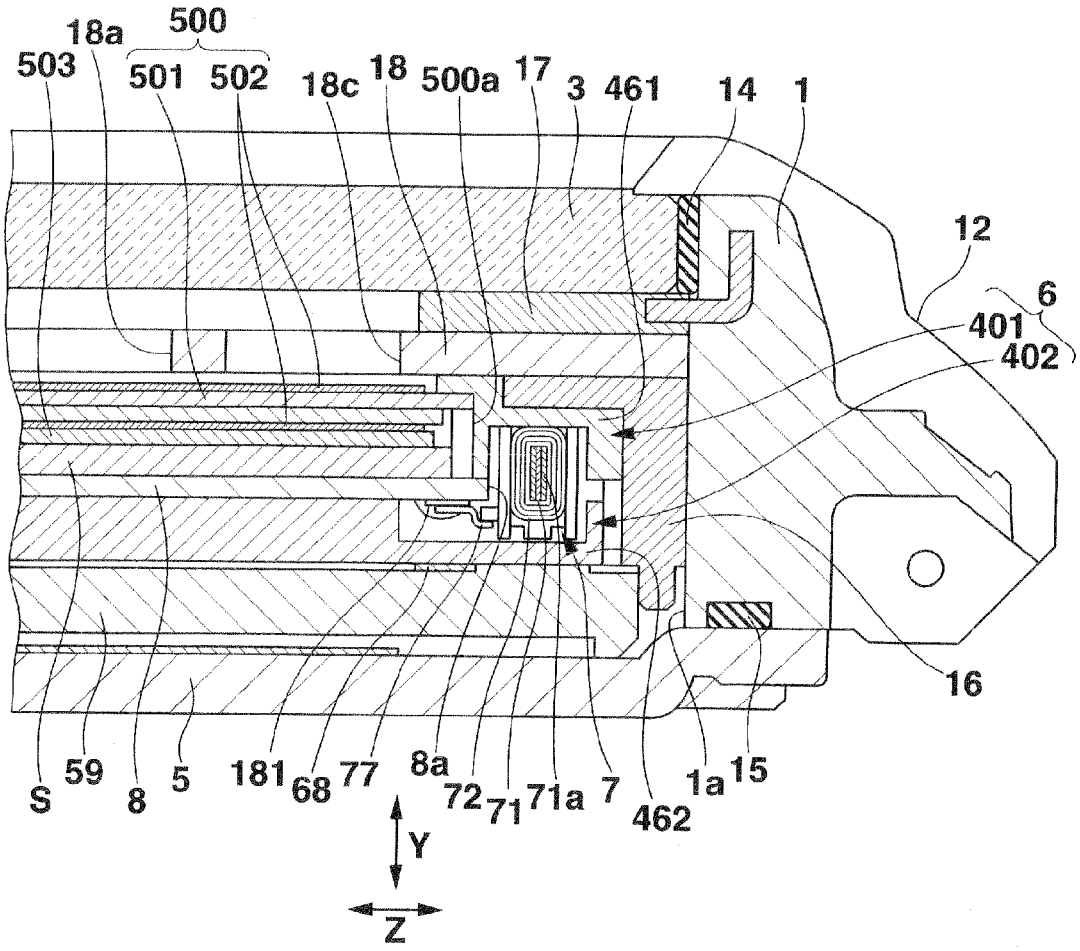
FIG. 16 is a cross-sectional view taken along the line XVI-XVI of FIG. 15.
Figure 17:
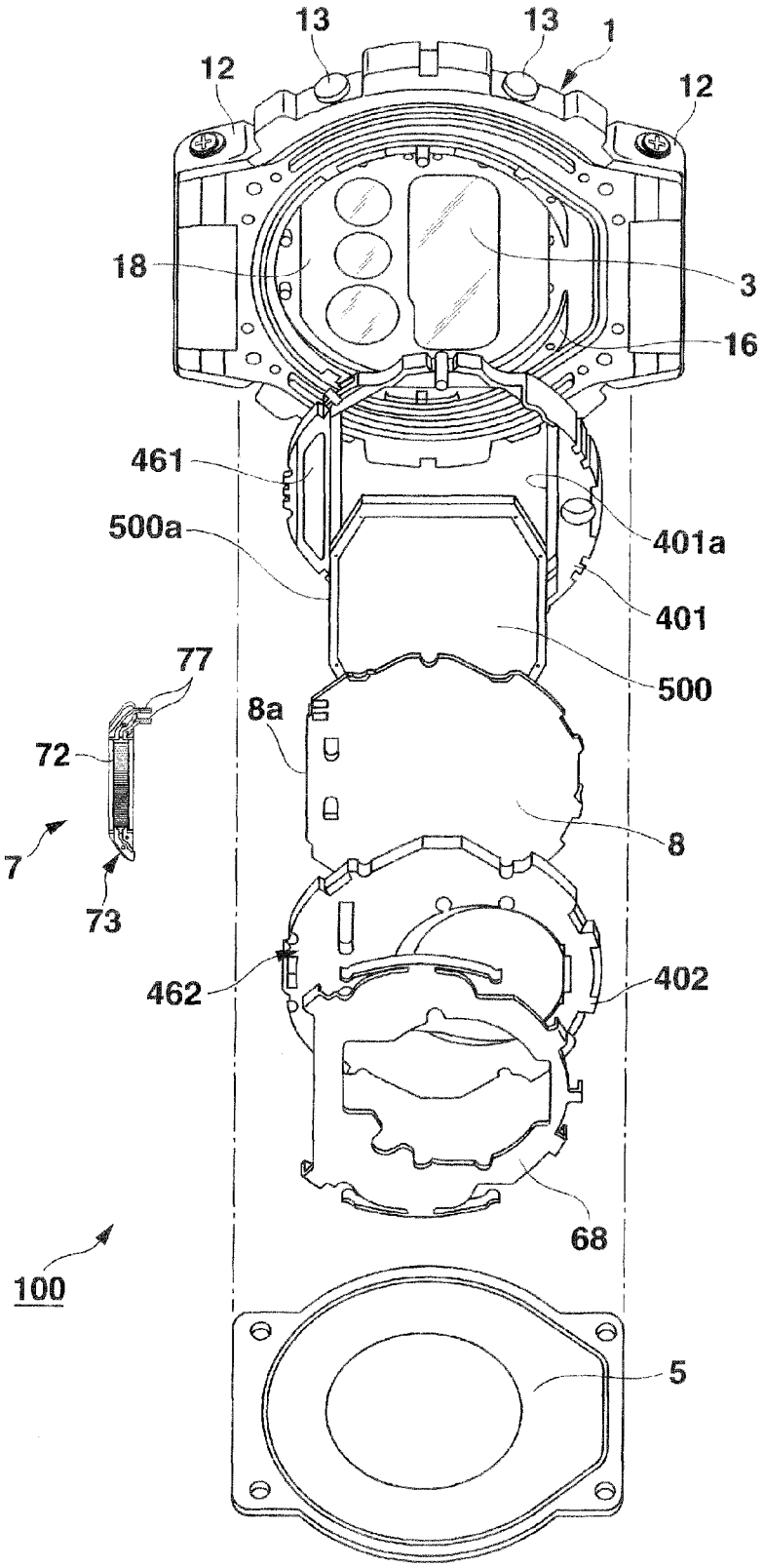
FIG. 17 is an explored perspective view of the wristwatch of FIG. 15.

FIG. 15 is a front view of a radio-wave controlled wristwatch according to a fifth embodiment of the present invention. FIG. 16 is a cross-sectional view taken along the line XVI-XVI of FIG. 1. FIG. 17 is an explored perspective view of the wristwatch of FIG. 15. Structural portions of the fifth embodiment different from the first-fourth embodiments will be described below.

Referring to FIGS. 15-17, in this embodiment, a radio-wave controlled wristwatch 100 has a ring-like frame 16 fitting into a case 1 to suppress parts provided within the case 1 from being unsteady and absorb external shocks. A glass cover 3 is attached through a waterproof ring 14 to one end of the case 1.

Disposed between the glass cover 3 and dial 18 the dial 18. As shown in FIG. 16, a back cover 2 is attached through a waterproof ring 15 to the other end of the case 1. The parts accommodated within the case 1 include various electronic parts 81, a circuit board 8 and an antenna structure 7.

The dial 18 has openings 18*a*, 18*b* and 18*c* through which a user can watch respective display sections of a liquid crystal panel 500. The liquid crystal panel 500, the circuit board 8 and the antenna structure 7 are accommodated within a module member 6 of a non-metal material such as a synthetic resin. The module member 6 is made of first and second module submembers 401 and 402.

The first module submember 401 is in the form of a ring-like, frame provided on a front or viewing side of the case 1 and has an opening 41*a* (see FIG. 17) into which the liquid crystal panel 500, which is superimposed on the circuit board 8, is fitted such that a display area 50 (see FIG. 25) appears on the side of the dial plate 18. The second module submember 402 is in the form of a plate- or disk-like plate positioned on the Pack side of the case 1 and includes a battery chamber (not shown).

Figure 24:
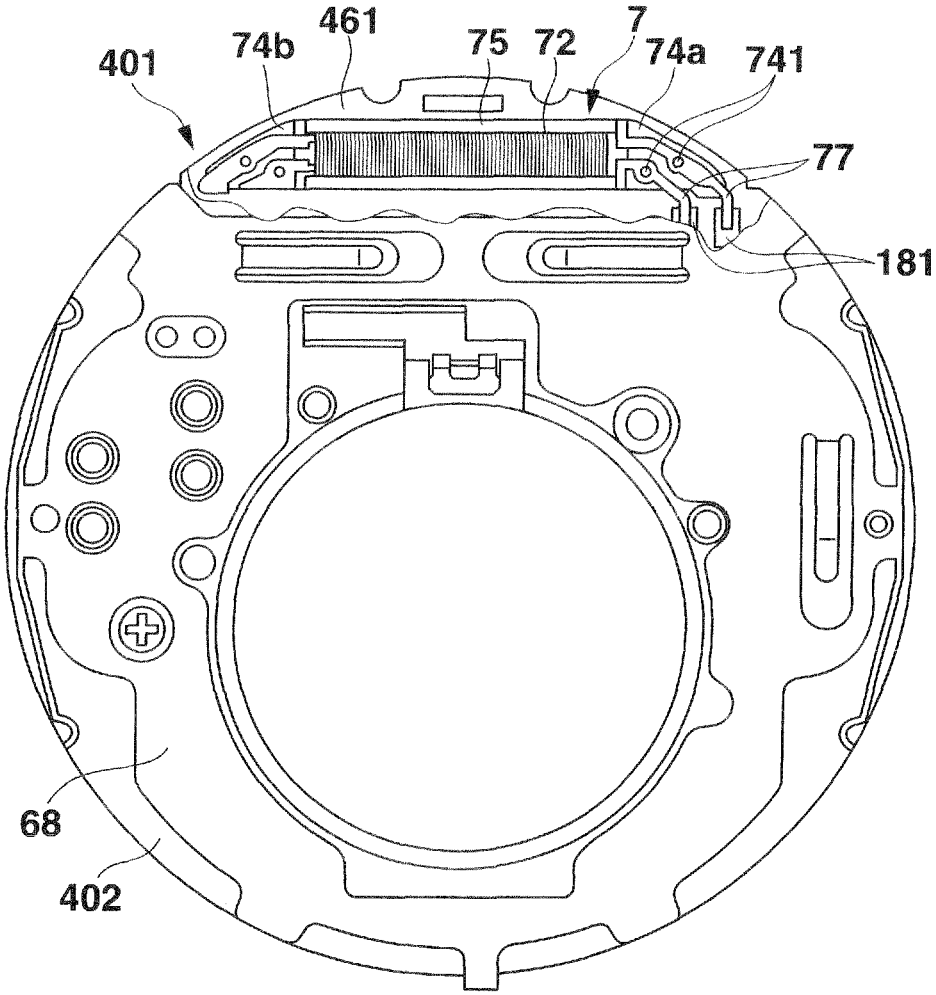
FIG. 24 is a plan view of the module member in which the antenna structure and the circuit board are provided.
Figure 25:
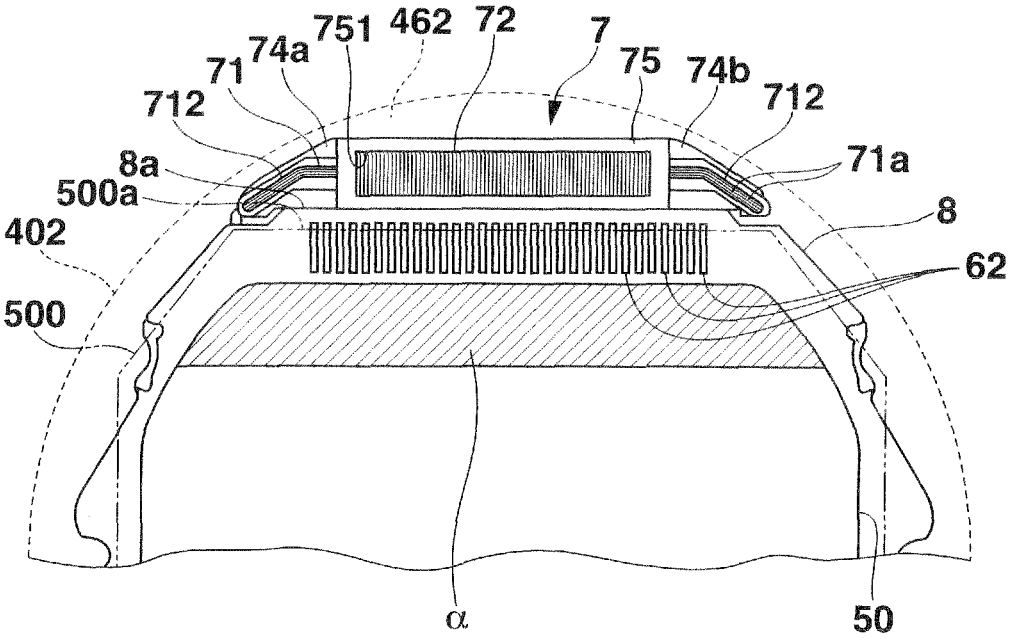
FIG. 25 is a plan view of the wristwatch, illustrating a positional relationship in position between the antenna structure, circuit board and liquid crystal panel.

The first and second module submembers 401 and 402 fit into each other to form the module member 6 as a unit. The first and second module submembers 401 and 402 have antenna support areas 461 and 462, including upper parts thereof, as shown in FIGS. 24 and 25, respectively, between which the antenna structure 7 is supported on the wristwatch (see FIGS. 16, 24 and 25).

As shown in FIG. 16, the liquid crystal panel 500, a spacer S and the circuit board 8 are held layered between the first and second module submembers 401 and 402, which are supported and secured by a module hold member 59 from the back side of the wristwatch 100 within the case 1. G circuit board holder 68 is provided to secure the circuit board 8 to the first and second module submembers 401 and 402.

However, the circuit board holder 68 and the module hold member 59 are not indispensable components. For example, the module submembers 401 and 402 combined integrally by engaging means may be supported by the back member 5 without using the circuit and module hold members 68 and 59.

The liquid crystal panel 500 includes, for example, a liquid crystal board 501 composed of two glass plates between which a liquid crystal material is sealed, a pair of polarizing plates between which the liquid crystal board 501 is held, as shown in FIG. 2, and a back light 503 disposed below the polarizing plates 502. The back light 503 includes, for example, an EL (Electro-Luminescence) element.

The structure and shape of the liquid crystal panel 500 is not limited to the illustrated one. The liquid crystal panel 500 has a straight side edge 500*a* (see FIG. 17) entering between the antenna support areas 461 and 462 of the module member 6 when the liquid crystal panel 500 is disposed within the module member 6.

Figure 18:
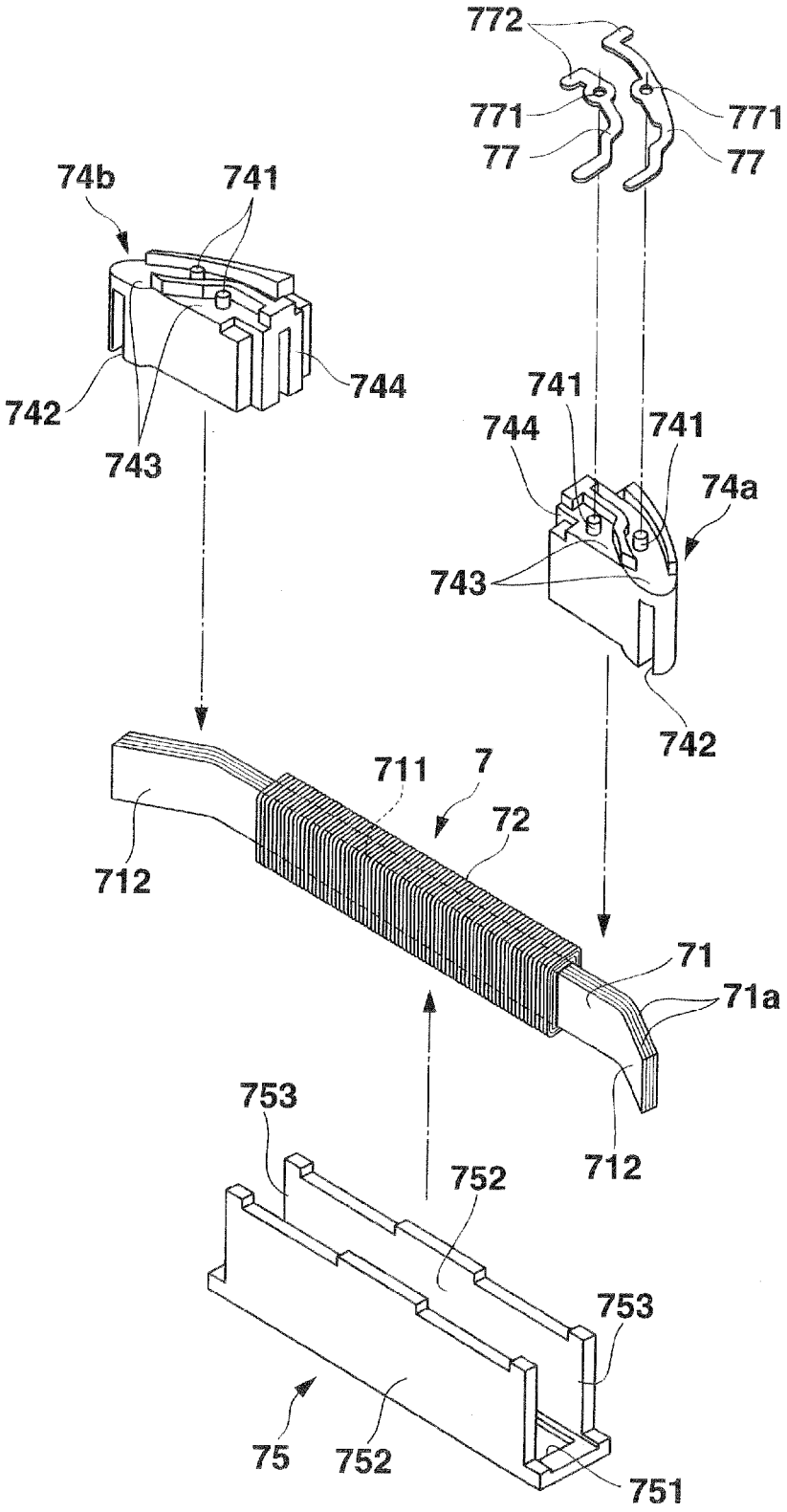
FIG. 18 is an explored perspective view of an antenna structure provided within the wristwatch of FIG. 17.

In this embodiment, as shown in FIGS. 17 and 18, the circuit board 8 is in substantially the form of a disk. The circuit board 8 has a straight edge 8*a* (see FIG. 17) entering between the antenna support areas 461 and 462 of the module member when the circuit board 8 is accommodated within the module member 6.

The antenna structure 7 is disposed out side along and in common to the straight edges 500*a* and 8*a* of the layered liquid crystal panel 500 and circuit board 8 (see FIG. 25). The antenna structure 7 includes the core 71 of strip-like magnetic layers 71*a* layered in the direction perpendicular to the direction in which the liquid crystal panel 500 and the circuit board 8 are superimposed.

Thus, an extra extent of the liquid crystal panel 500 and circuit board 8 does not occur, thereby accommodating the antenna structure 7 in a compact manner within the case 1.

Figure 22:
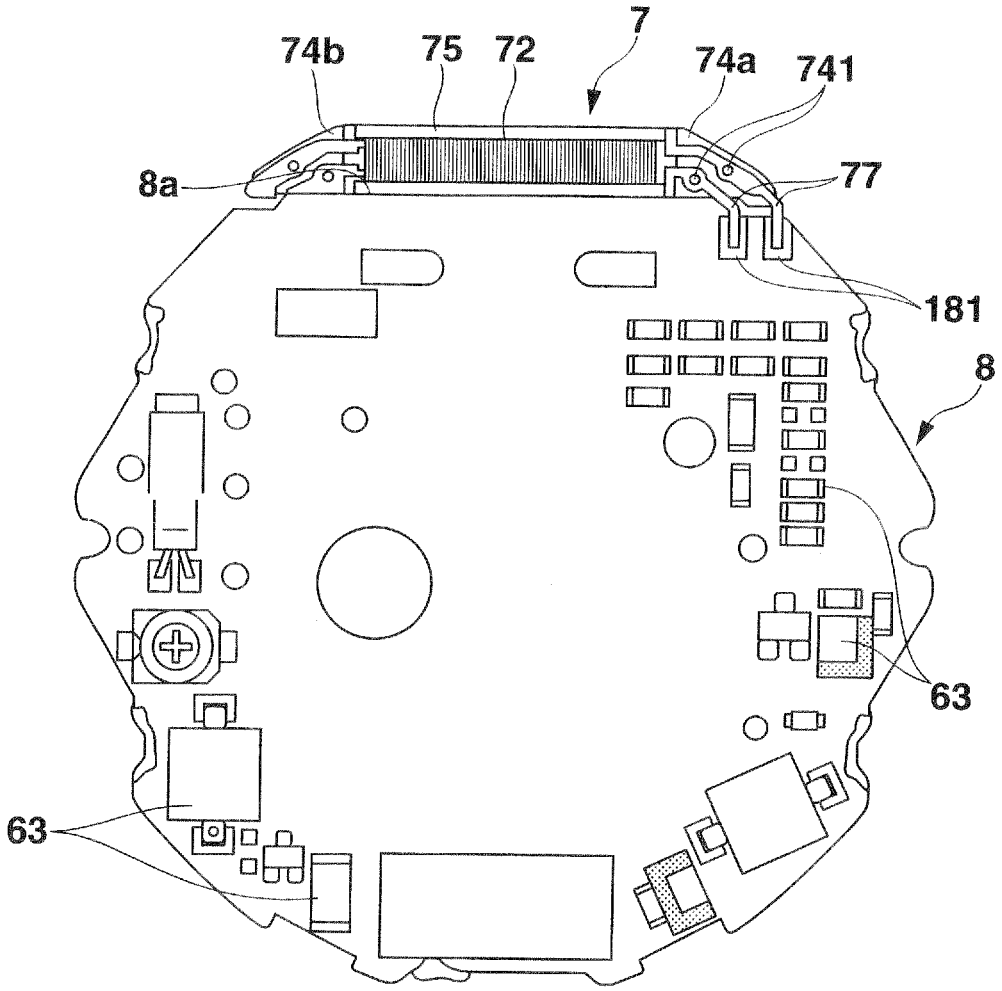
FIG. 22 is a bottom view of a circuit board with the antenna structure secured to the circuit board disposed within the wristwatch.
Figure 23:
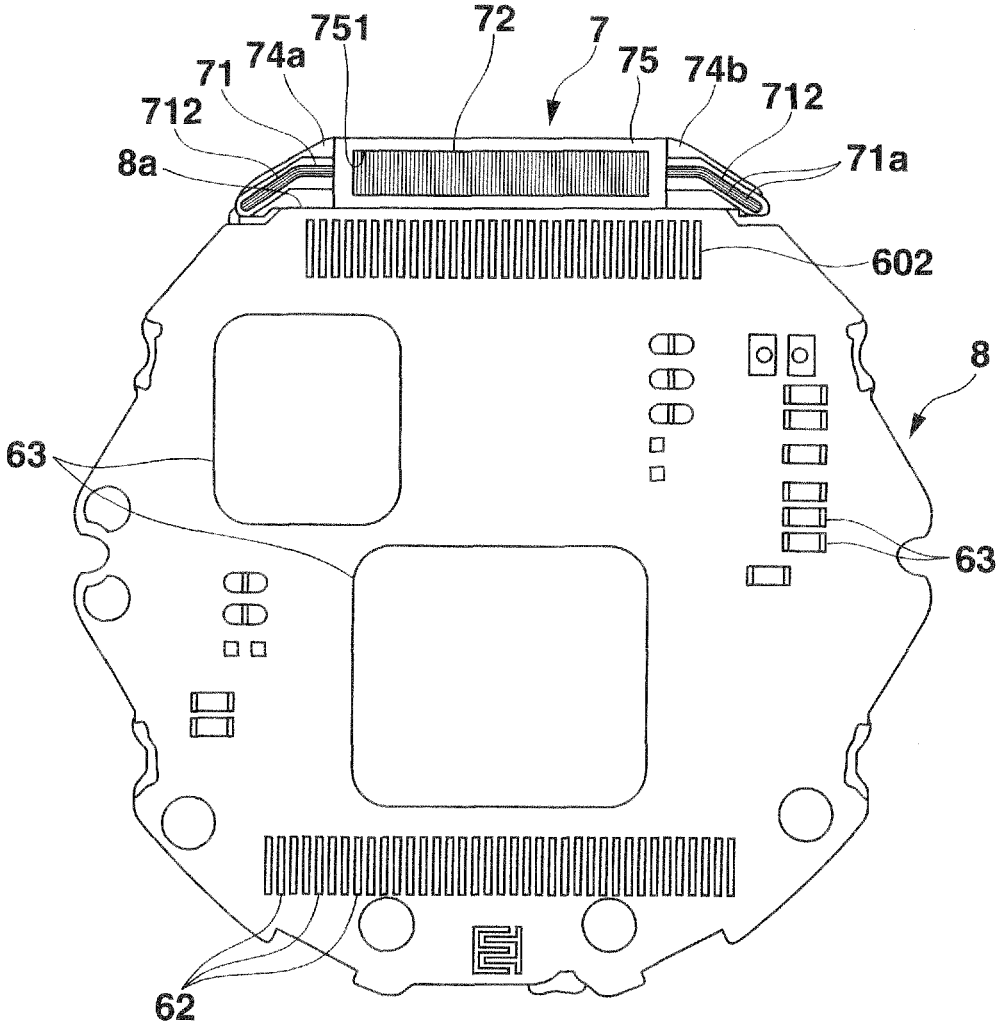
FIG. 23 is a plan view of the circuit board with the antenna structure secured to the circuit board disposed within the wristwatch.

As shown in FIG. 22, a pair of terminals 81 is provided on the back of the circuit board 8 near the right-hand end of the antenna structure 7 to hold leads 77 of the antenna structure 7. As shown in FIG. 23, a plurality of terminals 602 for the liquid crystal panel 500 is provided along the straight edge 8*a* of the circuit board 8 on its viewing side.

Disposed on the circuit board 8 are various electronic parts 81 including, for example, a control IC such as a GPO which controls its associated components of the wristwatch 100, a receiver circuit which amplifies and demodulates standard radio waves detected by the antenna structure 7 to provide time data included in the standard radio waves, and a time counter which includes an oscillator for counting current time (None of these components are shown).

Figure 19:
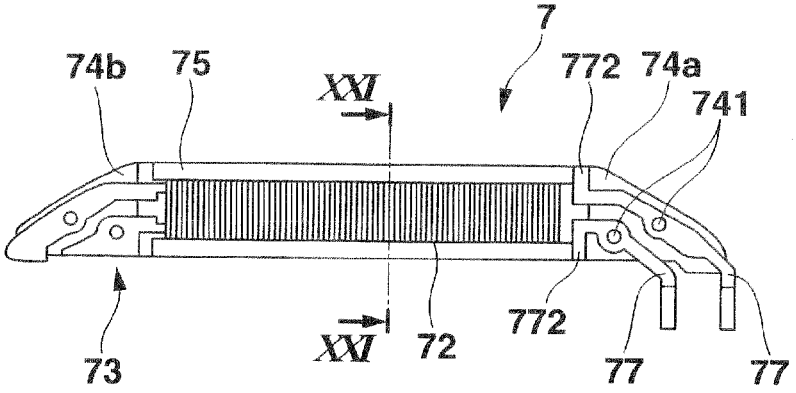
FIG. 19 is a bottom view of the antenna structure of FIG. 18 provided within the wristwatch.
Figure 20:
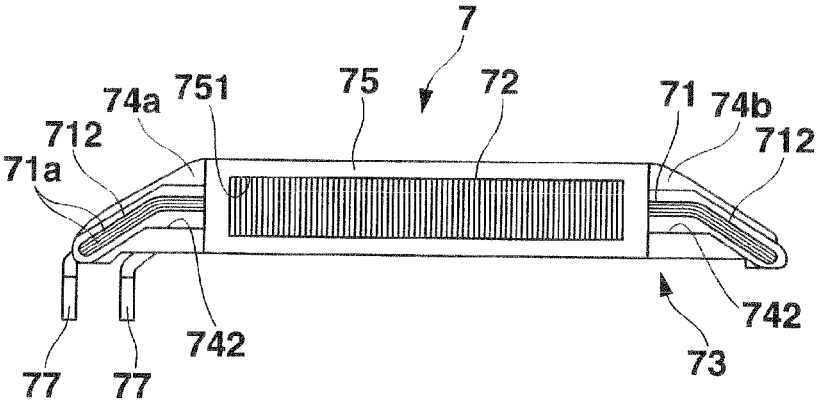
FIG. 20 is a top plan view of the antenna structure of FIG. 18 provided within the wristwatch.
Figure 21:
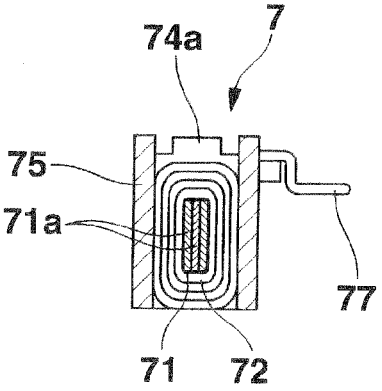
FIG. 21 is a cross-sectional view taken along the line XXI-XXI of FIG. 19.

Referring to FIGS. 18-21, the antenna structure 7 of this embodiment will be described more specifically. FIG. 18 is an explored perspective view of the antenna structure 7. FIG. 19 is a bottom view of the antenna structure provided within the wristwatch 100, as viewed from below or from the back cover 2 side. FIG. 20 is a top plan view of the antenna structure provided within the wristwatch, as viewed from the dial 18 side. FIG. 21 is a cross-sectional view taken along the line XXI-XXI of FIG. 19.

As shown in FIG. 18, the antenna structure 7 in the embodiment comprises an elongated core 71 and a coil 72 wound around the core such that when radio waves pass through the core 71, a voltage will be induced across the coil 72.

The core 71 is composed of a plurality of strip-like magnetic layers 71*a* layered perpendicular to the direction in which the circuit board 8 and the liquid crystal panel 500 are superimposed. The number of strip-like layers 71*a* is not limited especially. Preferably, the strip-like layers 71*a* are secured mutually with adhesive so as to maintain the layered state thereof.

Each strip-like layer 71*a* is made of a magnetic material of a high magnetic permeability μ (μ is a constant of proportion when a relationship between a strength of magnetic field H and a magnetic flux B is shown by B=μH) or of a high relative magnetic permeability μs (=μ/μ0; where μ0 is the magnetic permeability in a vacuum) such as an amorphous alloy.

However, the material forming the core 71 is not limited to the amorphous alloy, and another magnetic material which is formable to a thin plate may be used to form the core 71.

As shown in FIG. 18, the core 71 has a straight central part 711 around which the coil 72 is wound. Both end portions 712 of the core 71 are bent respectively so as to extend along between the outer periphery of the first and second module members 401 and 402 and the inner periphery of the annular case 1.

In this embodiment, the antenna structure 7 has a resin core case 73 (see FIG. 17) which holds the core 71. As shown in FIG. 18, the core case 73 includes a pair of first synthetic-resin-molded case members 74*a* and 74*b* which cover respective end portions of the core 71, and a second single case member 75 which covers the coil 72 wound around the core 71.

A pair of leads 77 is arranged to be supported by a pair of projections 741 provided in a pair of recesses 743 formed on the back of each of the first case member 74*a* and 74*b* when the antenna structure 7 is disposed within the case 1 such that a hole 771 formed in each lead 77 fits over a respective projection 741.

Each of the first case members 74*a* and 74*b* has a groove 742 (see FIG. 20) on the viewing side thereof into which a respective one of the end portions of the core 71 is inserted when the antenna structure 7 is disposed within the case 1. The first case members 74*a* and 74*b* each also have a projection 744 on its side facing the coil 72 engaging a respective one of ends of the second case member 75.

As shown in FIG. 19, while in this embodiment the leads 77 are illustrated as disposed on the right-hand first case member 74*a*, they may be instead disposed on the left-hand first case member 74*b* depending on the structure of a circuit pattern formed on the circuit board 6.

While in this embodiment the pair of lead receiving recesses 743 and the pair of lead-fitting-over projections 741 are illustrated as being formed on each of the pair of first case members 74*a* and 74*b* and the leads 77 are illustrated as connected to any of the first case members 74*a* and 74*b* depending on the pattern structure formed on the circuit board 3, the pair of lead receiving recesses 743 and the pair of lead-fitting-over projections 741 may be provided only on any one of the first case members 74*a* and 74*b*.

The pair of lead members 77 disposed on the first case member 74*a* is received in the pair of recesses 743 such that the leads 77 fit at their holes 771 over the projections 741 to secure the leads 77 to the first case member 74*a*. The leads 77 may be secured to the first case member 74*a* with adhesive.

The leads 77 are arranged to be connected at one end 772 to wire ends of the coil 72 and at the other end by soldering to antenna terminals 81 (see FIG. 22) provided on the circuit board 8 to send a signal obtained by the antenna structure 7 to the reception circuit provided on the circuit board 8.

FIG. 22 is a bottom view of the circuit board 8 with the antenna structure disposed within the case 1, as viewed from the back cover 2 side. FIG. 23 is a plan view of the circuit board with the antenna structure 7 secured to the circuit board 8 disposed within the case 1, as viewed from the viewing side of the wristwatch.

As shown in FIG. 22, in this embodiment, the antenna structure 7 is secured to the circuit board 8 by the leads 77, which also function as a holder which holds the antenna structure 7 on the circuit board 6.

The second case member 75 has a U-like cross section having substantially the same length as the coil 72 on the core 71 and a long axial opening 751 formed on its bottom extending along the length of the U-like section. The U-like sectional second case member 75 has between its two branches 752 a space substantially enough to receive the coil 72.

While the first case members 74*a* and 74*b* are fitted over both the end portions of the antenna core from above, the second case member 75 is fitted over the coil 72 from below or from the viewing side of the antenna structure 7 disposed within the case 1 such that the coil 72 is disposed between the branches 752 of the second case member 75. The second case member 75 is open at its both ends 753 into which respective facing projections 744 of the first cases 74*a* and 74*b* are engaged.

Then, the fabricating method of the radio-wave controlled wristwatch 100 of this embodiment will be described. First, the plurality of strip-like magnetic layers 71*a* are layered and secured together with adhesive, and then bent so as to provide the bent end portions 712. Alternatively, the respective layers 71*a* may be bent beforehand. Then, the first case members 74*a* and 74*b* are fitted over the respective end portions of the core 71.

Then, the coil 72 is formed on the central straight part 711 of the core 71. In order to fix the coil 72 itself, the coil may be impregnated with adhesive. The leads 77 are attached to the first case member 74*a*, and then wire ends of the coil 72 are respectively connected to ends 772 of the leads 77.

Then, the second case member 75 is fitted over the coil 72 from the side of the coil 72 opposite the first case members 74*a* and 74*h* so as to hold the coil 72 between the branches of the U-like part thereof.

At this time, the projections 744 of the first case members 74*a* and 74*b* fit into the respective side openings 753 in the second case member 75, thereby completing the antenna structure 7 with a core case 73 where the first case members 74*a* and 74*b* are integrally combined with the second case member 75.

Then, in order to dispose the antenna structure between the first and second module submembers 401 and 402, the leads 77 are connected electrically by soldering to the antenna terminals 81 on the circuit board 8. Then, the liquid crystal panel 500 is superimposed on the circuit hoard 8, to which the antenna structure 7 is connected, such that both the straight edges 500*a* and 8*a* of the liquid crystal panel 500 and circuit board 8 coincide.

Then, the antenna structure 7 is disposed outside along both the coinciding straight edges 500*a* and 8*a* of the layered liquid crystal panel 500 and circuit board 8 and secured to these members. Then, resulting assembly is held between the first and second module submembers 401 and 402 and then these submembers are secured integrally with each other, for example, with screws.

FIG. 24 shows the position of the antenna structure 7 within the module member 6 by removing part of the module member. FIG. 25 schematically illustrates the positional relationship among the antenna structure 7, circuit board 8 and liquid crystal panel 500.

As shown in FIGS. 24 and 25, the antenna structure 7 is supported between antenna support areas 461 and 412 of the first and second module submembers 401 and 402 so as not to be unsteady within the module member 6.

Differences between the radio-wave controlled wristwatch of the present embodiment and the prior art radio-wave controlled wristwatch will be described. With the antenna structure of the prior art wristwatch, the plurality of strip-like layers of the core are layered in the same direction as the circuit board, the wristwatch module member and the liquid crystal panel are layered.

Thus, in order to dispose the antenna structure within the case, the case is required to have an inner space wider by the width of each strip-like layer. Therefore, the display area of the liquid crystal panel is limited accordingly.

In contrast, with the present embodiment, the antenna structure 7 is provided outside along and in common to both the coinciding straight edges 500*a* and 8*a* of the layered liquid crystal panel 500 and circuit board 8, respectively. Further, the core of the antenna structure 7 includes the plurality strip-like magnetic layers 71*a* layered in the direction perpendicular to the direction in which the liquid crystal panel 500 and the circuit board 8 are layered.

Thus, the space within the case 1 for accommodating the liquid crystal panel 500 and the circuit board 8 is reduced in a diametral direction of the case 1 perpendicular to the extending direction of the antenna core 71 to accommodate the antenna structure 7 within the case in a compact manner.

That is, the display area 50 of the liquid crystal panel 500 is widened by a hatched area a in FIG. 25 compared to the prior art, as shown by a two-dot-dashed line in FIG. 25.

The circuit board 8, the liquid crystal panel 500 and the antenna structure 7 are disposed within the module member 6. Then, a resulting assembly is disposed within the case 1 and fixed by a module holder 59 from the back side. Then, the back-side opening end of the case 1 is closed with the back cover 2, thereby completing the fabrication of the radio-wave controlled wristwatch 100.

In operation, when the standard radio waves are received, the magnetic components of external radio waves enter the antenna core 71 through the non-conductive glass cover 3 and dial 18. Then, the magnetic flux is guided to the coil 72 wound around the core 71, thereby inducing a voltage across the coil 72 due to changes in the magnetic flux linking with the coil 72.

This voltage is delivered as an analog signal to a receiver circuit (not shown) provided on the circuit board 8. A current time is set based on time data included in the analog signal, as required.

As described above, according to this embodiment, the plurality of strip-like magnetic layers 71*a* composing the core 71 of the antenna structure 7 is layered in a direction perpendicular to the direction in which the circuit board 8 and the liquid crystal panel 500 are layered. Thus, the antenna structure 7 is disposed in a compact manner within the case 1.

The antenna structure 7 is disposed outside along and in common to both the straight edges 500*a* and 8*a* of the layered liquid crystal panel 500 and circuit board 8 within the limited extent of the module member 6.

Thus, the display area 50 of the liquid crystal panel 500 is large compared to the prior art, thereby improving visibility of the liquid crystal panel 500 and providing various displays.

The antenna structure 7 includes the elongated core 71 of layered strip-like magnetic layers 71*a* having end portions 712 bent so as to extend along the inner periphery of the case 1. Thus, the bent end portions of the core 71 can collect magnetic flux efficiently, thereby providing a small radio-wave controlled wristwatch 100 with high reception sensitivity.

Since the core case 73 holds the core 71 of strip-like layers 71*a*, the ends of the core 71 are protected from being broken and also the core 71 is prevented from contacting parts 81 mounted on the circuit board 8 and hence leading to short circuits.

The antenna structure 7 is connected to the circuit board 8 only by the leads 77, which also function as the holder which holds the antenna structure 7 on the circuit board 8. Thus, no further separate means for fixing the antenna structure 7 need be provided. Thus, the number of parts of the wristwatch and therefore its cost are reduced. The man hour for assembling work is reduced, thereby simplifying the assembling of the wristwatch.

The first and second module submembers 401 and 402 have antenna support areas 461 and 462, respectively, between which the antenna structure disposed near the outer periphery of the first and second module submembers 401 and 402 is held. Thus, although the antenna structure 7 is connected to the circuit board 8 only by the leads 77, the antenna structure 7 is prevented from being unsteady, and held in a stabilized manner.

The present invention is not limited to the above embodiments.

For example, while in this embodiment only the leads 77 provided on the first case member 74*a* are illustrated as also functioning as the holder for the antenna structure 7 on the circuit, board 8, the structure for holding the antenna structure 7 on the circuit board 8 is not limited to the illustrated one.

For example, second leads like the above mentioned leads 77 may be provided on the first case member 74*b* to secure the antenna structure 7 to the circuit board 8 in cooperation with the first-mentioned leads 77. In this case, the second leads provided on the first case member 74*b* should be prevented from electrically contacting the circuit board 8. In this case, they are not used as connection terminals may be used as a grounding terminal.

While in the embodiment the core case 73 is illustrated as composed of the first case member 74*a* and 74*b* and the second case member 75, the structure of the core case 73 is not limited to the illustrated one. For example, another core case 73 may be composed of only the first case member 74*a* and 74*b* which cover both the end portions, respectively, of the core 71.

While in this embodiment the module member 6 is illustrated as composed of the first and second module submembers 401 and 402, the structure of the module member 6 is not limited to the illustrated one. For example, it may be composed of only members which hold the circuit board 8 and the liquid crystal panel 500 from the side of the back cover 2.

While in this embodiment the first and second module submembers 401 and 402 are illustrated as including the antenna support areas 461 and 422, respectively, only one of the first and second module members 401 and 402 may include an antenna support such as shown by 461 or 422.

While in this embodiment the core 71 of the antenna structure 7 is illustrated as being constructed by layering the plurality of strip-like magnetic layers 71*a*, and then bending both end portions of the layered strip-like layers 71*a* so as to extend along the outer periphery of the first and second module submembers 401 and 402, the structure of the core 71 is not limited to the illustrated one. For example, a plurality of strip-like magnetic members whose end portions are beforehand bent may be layered to form a core.

While in this embodiment the wristwatch case 1 is illustrated as circular, the shape of the case 1 is not limited to the illustrated one. For example, it may be square or polygonal. Preferably, the antenna structure 7 has a shape such as conforms to the inner shape of the case 1, thereby ensuring as wide a space as possible within the case 1.

While in this embodiment the circuit board 8 is illustrated as taking substantially the form of a disk, but it is not limited to the illustrated one. When the circuit board 8 is square, any one side of the circuit board 6 may be used as a straight edge along which the antenna structure 7 is disposed.

The shape of the liquid crystal panel 500 and the layout of the dial 18 are not limited to the illustrated ones. The solar cell 17 is not an indispensable component, but optional.

A synthetic resin material for molding the first and second module submembers 401 and 402 may be, for example, epoxy resin, ABS resin, etc. Among these resins, phenolic and epoxy resins are preferable from the standpoint of heat resistance, size stability, and strength.

While in this embodiment the electronic device which includes the inventive antenna structure illustrated as a radio-wave controlled wristwatch, it is not limited to the illustrated one, but it may be any electronic devices which can receive radio waves with an antenna structure. For example, the inventive antenna structure may be applied to fixed type radio-wave controlled timepieces, small radios and mobile terminals.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna device comprising:

a plate shaped module member to be accommodated within a hollow cylindrical case;

an antenna structure disposed on a side position of the module member, the antenna structure comprising: (i) a core including a plurality of magnetic strips layered on each other in a direction perpendicular to a thickness direction of the module member, wherein the core has a central straight part and bent end portions that extend from both ends of the central straight part and that are bent to conform to an inner periphery of the cylindrical case, (ii) a coil wound around the central straight part; and a pair of magnetic flux collectors, each of which is magnetically coupled with a respective one of the bent end portions of the core;

wherein each of the pair of magnetic flux collectors comprises a plurality of magnetic plates layered on each other in the thickness direction of the module member, such that the magnetic plates of the magnetic flux collectors are perpendicular to the magnetic strips of the core.

2. The antenna device of claim 1, wherein the module member comprises an antenna mounting portion and an electronic parts holding portion which holds a plurality of electronic parts, and the antenna structure is mounted on the antenna mounting portion.

3. The antenna device of claim 2, wherein the antenna mounting portion includes a pair of recessed areas formed in an outer periphery of the module member, and the bent end portions of the core are disposed in the recessed areas.

4. The antenna device of claim 2, wherein the antenna mounting portion includes a pair of grooves formed in an outer periphery of the module member, and the bent end portions of the core are disposed in the grooves.

5. A radio-wave receiver comprising:

a hollow cylindrical case;

a plate shaped module member accommodated within the cylindrical case;

a transparent member closing a first open end of the cylindrical case;

a cover closing a second open end of the cylindrical case;

an antenna structure disposed on a side position of the module member, the antenna structure comprising: (i) a core including a plurality of magnetic strips layered on each other in a direction perpendicular to a thickness direction of the module member, wherein the core has a central straight part and bent end portions that extend from both ends of the central straight part and that are bent to conform to an inner periphery of the cylindrical case, and (ii) a coil wound around the central straight part; and a pair of magnetic flux collectors each of which is magnetically coupled with a respective one of the bent end portions of the core;

wherein each of the pair of magnetic flux collectors comprises a plurality of magnetic plates layered on each other in the thickness direction of the module member, such that the magnetic plates of the magnetic flux collectors are perpendicular to the magnetic strips of the core.

6. An antenna device comprising:

a module member to be accommodated within a hollow cylindrical case;

a circuit board disposed parallel to the module member;

a display member disposed above and parallel to the circuit board; and an antenna structure comprising: (i) a core including a plurality of magnetic strips layered on each other in a direction perpendicular to a direction in which the circuit board and the display member are disposed on each other, wherein the core has a central straight part and bent end portions that extend from both ends of the central straight part and that are bent to conform to an inner periphery of the cylindrical case, and (ii) a coil wound around the central straight part;

wherein the antenna structure is positioned to extend along side surfaces of both of the circuit board and the display member.

7. The antenna device of claim 6, wherein the display member comprises a liquid crystal panel, and wherein each of the liquid crystal panel and the circuit board has a disc shape with a straight side adjacent to the antenna structure.

8. The antenna device of claim 6, wherein the antenna structure is connected to the circuit board through lead members, and the lead members also function as holding members which hold the antenna structure to the circuit board.

9. The antenna device of claim 6, wherein the antenna structure further comprises a core case which holds the core.

10. A radio-wave receiver comprising:

a hollow cylindrical case;

a module member accommodated within the cylindrical case;

a circuit board disposed parallel to the module member;

a display member disposed above and parallel to the circuit board; and an antenna structure comprising: (i) a core including a plurality of magnetic strips layered on each other in a direction perpendicular to a direction in which the circuit board and the display member are disposed on each other, wherein the core has a central straight part and bent end portions that extend from both ends of the central straight part and that are bent to conform to an inner periphery of the cylindrical case, and (ii) a coil wound around the central straight part;

wherein the antenna structure is positioned to extend along side surfaces of both of the circuit board and the display member.

11. The radio-wave receiver of claim 10, wherein the display member comprises a liquid crystal panel, and wherein each of the liquid crystal panel and the circuit board has a disc shape with a straight side adjacent to the antenna structure.

12. The radio-wave receiver of claim 10, wherein the antenna structure is connected to the circuit board through lead members, and the lead members also function as holding members which hold the antenna structure to the circuit board.

13. The radio-wave receiver of claim 10, wherein the antenna structure further comprises a core case which holds the core.

* * * * *